US011130342B2

(12) United States Patent
Yoshida et al.

(10) Patent No.: US 11,130,342 B2
(45) Date of Patent: Sep. 28, 2021

(54) LIQUID EJECTING APPARATUS AND METHOD OF CONTROLLING LIQUID EJECTING APPARATUS

(71) Applicant: SEIKO EPSON CORPORATION, Tokyo (JP)

(72) Inventors: Atsushi Yoshida, Matsumoto (JP); Kiyoteru Katsuki, Azumino (JP); Junya Suzuki, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/745,735

(22) Filed: Jan. 17, 2020

(65) Prior Publication Data

US 2020/0230961 A1 Jul. 23, 2020

(30) Foreign Application Priority Data

Jan. 21, 2019 (JP) ..... JP2019-007722

(51) Int. Cl.
*B41J 2/165* (2006.01)
*B41J 2/175* (2006.01)
(Continued)

(52) U.S. Cl.
CPC ..... *B41J 2/16535* (2013.01); *B41J 2/17509* (2013.01); *B41J 29/13* (2013.01);
(Continued)

(58) Field of Classification Search
CPC ..... B41J 2/16535; B41J 2002/022; B41J 2/17509; B41J 29/13; B41J 29/02; B41J 19/202; B41J 2/16508; B41J 2/16547; B41J 2/16538; B41J 2002/1655; B41J 2002/16514; B41J 2/16532; B41J 2/16526; B41J 2/01
See application file for complete search history.

(56) References Cited

U.S. PATENT DOCUMENTS 6,336,698 B1 1/2002 Imai
2002/0015608 A1* 2/2002 Williams ..... B41J 2/17526 400/279
(Continued)

FOREIGN PATENT DOCUMENTS

EP 1386742 2/2004
JP H09-109413 4/1997
(Continued)

*Primary Examiner* — Yaovi M Ameh
(74) *Attorney, Agent, or Firm* — Workman Nydegger

(57) ABSTRACT

A liquid ejecting apparatus includes a carriage that mounts a liquid ejecting head provided with a nozzle surface in which nozzles to eject a liquid are formed, and is configured to move the liquid ejecting head between an ejection area used to cause the liquid ejecting head to eject the liquid onto a medium and a maintenance area used to perform maintenance of the liquid ejecting head, and a liquid receiving portion that has a size equal to or larger than the nozzle surface, is opposed to the nozzle surface located at a detachment position defined in the maintenance area, and receives the liquid discharged from the nozzles when detaching a liquid supply coupling portion detachably coupled to the liquid ejecting head.

9 Claims, 14 Drawing Sheets

(51) Int. Cl.

| | |
|---|---|
| ***B41J 29/13*** | (2006.01) |
| *B41J 2/02* | (2006.01) |
| *B41J 19/20* | (2006.01) |
| *B41J 2/01* | (2006.01) |

(52) U.S. Cl.
CPC ..... *B41J 2/01* (2013.01); *B41J 2/16508* (2013.01); *B41J 2/16526* (2013.01); *B41J 2/16538* (2013.01); *B41J 2/16547* (2013.01); *B41J 19/202* (2013.01); *B41J 2002/022* (2013.01)

(56) References Cited

U.S. PATENT DOCUMENTS

| | | | | |
|---|---|---|---|---|
| 2002/0149633 | A1* | 10/2002 | Murakami | B41J 2/17513 347/7 |
| 2012/0050421 | A1 | 3/2012 | Hamasaki et al. | |
| 2015/0124023 | A1* | 5/2015 | Hara | B41J 2/16544 347/33 |
| 2017/0203574 | A1* | 7/2017 | Shimomura | B41J 2/17556 |

FOREIGN PATENT DOCUMENTS

| | | | | |
|---|---|---|---|---|
| JP | 2002019090 | | 1/2002 | |
| JP | 2002225257 | | 8/2002 | |
| JP | 2002225257 | A * | 8/2002 | B41J 2/01 |
| JP | 2006192694 | | 7/2006 | |
| JP | 2007022093 | | 2/2007 | |
| JP | 2012051189 | | 3/2012 | |

* cited by examiner

LIQUID EJECTING APPARATUS AND METHOD OF CONTROLLING LIQUID EJECTING APPARATUS

The present application is based on, and claims priority from JP Application Serial Number 2019-007722, filed Jan. 21, 2019, the disclosure of which is hereby incorporated by reference herein in its entirety.

BACKGROUND

1. Technical Field

The present disclosure relates to a liquid ejecting apparatus such as a printer, and to a method of controlling a liquid ejecting apparatus.

2. Related Art

As disclosed in JP-A-2012-51189, for example, there is a printing apparatus representing an example of a liquid ejecting apparatus, which performs printing by ejecting an ink as an example of a liquid from a printing head portion as an example of a liquid ejecting head. The printing apparatus includes a carriage that detachably mounts a printing head, and a sub-tank representing an example of a liquid supply coupling portion held by the carriage. The sub-tank is detached from the carriage when replacing the printing head portion.

An operator carries out attachment and detachment of the liquid supply coupling portion to and from the carriage. If there is variation in coupling work to couple the liquid ejecting head to the liquid supply coupling portion or in attachment work to attach the liquid supply coupling portion to the carriage, the liquid ejecting apparatus may fail to ensure its performance quality after attachment and detachment of the liquid supply coupling portion to and from the carriage.

SUMMARY

An aspect of a liquid ejecting apparatus for solving the aforementioned problem includes: a carriage that mounts a liquid ejecting head provided with a nozzle surface in which nozzles to eject a liquid are formed, the carriage being configured to move the liquid ejecting head between an ejection area used to cause the liquid ejecting head to eject the liquid onto a medium and a maintenance area used to perform maintenance of the liquid ejecting head; a liquid supply coupling portion that is mounted on the carriage and is detachably coupled to the liquid ejecting head so as to supply the liquid to the liquid ejecting head; a carriage movement mechanism that moves the carriage, when detaching the liquid supply coupling portion, to a detachment position provided in the maintenance area; and a liquid receiving portion that has a size equal to or larger than the nozzle surface, is opposed to the nozzle surface located at the detachment position, and receives the liquid discharged from the nozzles.

An aspect of a method of controlling a liquid ejecting apparatus for solving the aforementioned problem is a method of controlling a liquid ejecting apparatus provided with: a carriage that mounts a liquid ejecting head provided with a nozzle surface in which nozzles to eject a liquid are formed, the carriage being configured to move the liquid ejecting head between an ejection area used to cause the liquid ejecting head to eject the liquid onto a medium and a maintenance area used to perform maintenance of the liquid ejecting head, a liquid supply coupling portion that is mounted on the carriage and is detachably coupled to the liquid ejecting head so as to supply the liquid to the liquid ejecting head, a carriage movement mechanism that moves the carriage, and a liquid receiving portion that has a size equal to or larger than the nozzle surface, is opposed to the nozzle surface located at a detachment position provided in the maintenance area, and receives the liquid discharged from the nozzles. The method includes moving the carriage so as to locate the liquid ejecting head at the detachment position when detaching the liquid supply coupling portion.

DESCRIPTION OF EXEMPLARY EMBODIMENTS

First Embodiment

Figure 1:
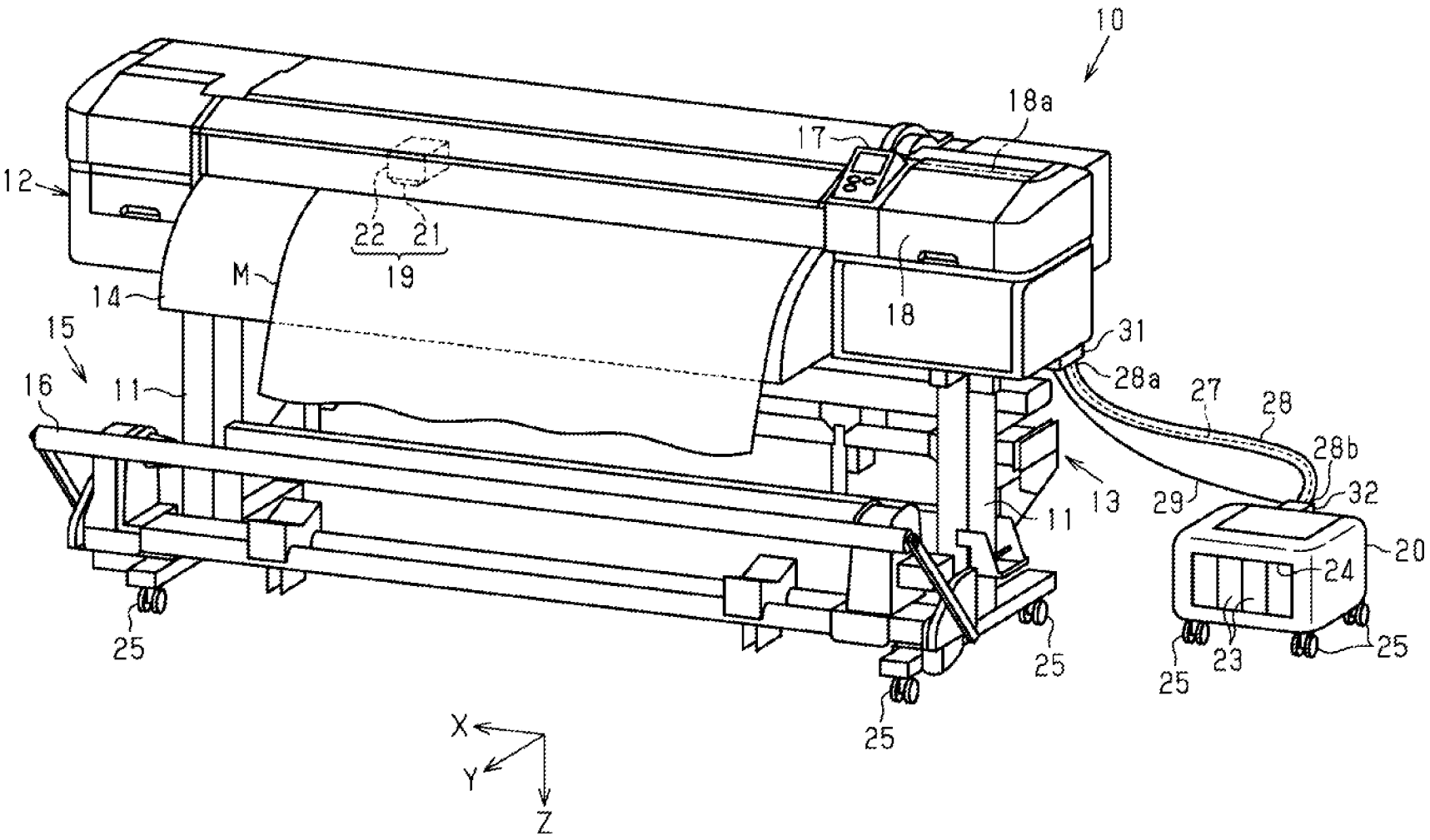
FIG. 1 is a perspective view of a liquid ejecting apparatus of a first embodiment.

A liquid ejecting apparatus of a first embodiment of the present disclosure will be described below with reference to the drawings. The liquid ejecting apparatus is an ink jet printer that performs printing by ejecting an ink representing an example of a liquid onto a medium such as paper. Meanwhile, the liquid ejecting apparatus is also a large-format printer that performs printing on a long medium.

In the drawings, a liquid ejecting apparatus 10 is assumed to be disposed on a horizontal plane and a direction of gravitational force is indicated with a Z-axis. Meanwhile, directions crossing the Z-axis are indicated with X-axis and Y-axis. When the X-axis, the Y-axis, and the Z-axis are orthogonal to one another, the X-axis and the Y-axis are in line with the horizontal plane. In the following description, a direction along with the X-axis may be referred to as a width direction X, a direction along with the Y-axis may be referred to as a depth direction Y, and a direction along with the Z-axis may be referred to as a vertical direction Z as appropriate.

As shown in FIG. 1, the liquid ejecting apparatus 10 includes a pair of legs 11, and a body 12 assembled on the legs 11. The liquid ejecting apparatus 10 includes a reel-out portion 13 that reels out a medium M rolled up in a rolled body toward the body 12, a guide plate 14 that guides the medium M discharged from the body 12, and a roll-up portion 15 that rolls up the medium M guided by the guide plate 14 into a rolled body. The liquid ejecting apparatus 10 includes a tension imparting mechanism 16 that imparts tension to the medium M being rolled up by the roll-up portion 15, an operation panel 17 to be operated by a user, and a maintenance cover 18 which is openable and closable. The maintenance cover 18 may be provided in such a way as to be turnable around a first shaft 18*a* being provided at a back end in the depth direction Y of the maintenance cover 18 and extending along the X-axis. The maintenance cover 18 is designed to be located at a closed position shown in FIG. 1 and at an open position shown in FIG. 9.

The operation panel 17 may notify the user of an operating state of the liquid ejecting apparatus 10 by displaying the operating state of the liquid ejecting apparatus 10. The operation panel 17 may be configured to operate the liquid ejecting apparatus 10 by way of a screen that displays the operating state, or may include a display screen used for displaying information and buttons used for conducting the operation.

The liquid ejecting apparatus 10 includes a printing portion 19 provided inside the body 12, and a liquid supply device 20 which is provided separately from the body 12. The printing portion 19 includes a liquid ejecting head 21 that ejects liquids and a carriage 22 that carries the liquid ejecting head 21. In this embodiment, a scanning direction of the carriage 22 is along the X-axis while an ejecting direction of the liquids ejected from the liquid ejecting head 21 is along the Z-axis.

The liquid supply device 20 may include an attachment portion 24 configured to attach liquid supply sources 23 that store the liquids. The liquid supply device 20 and the body 12 move relative to each other. The liquid ejecting apparatus 10 may include casters 25 so as to facilitate the movement of the body 12 and the liquid supply device 20.

The liquid ejecting apparatus 10 includes supply flow channels 27 that couple the liquid ejecting head 21 to the liquid supply sources 23 so as to supply the liquids inside the liquid supply sources 23 attached to the liquid supply device 20 to the liquid ejecting head 21, and a bellows tube 28 that protects part of the supply flow channels 27. The liquid ejecting apparatus 10 includes a coupling member 29 which couples the liquid supply device 20 to the body 12 so that the liquid supply device 20 can move relative to the body 12.

The coupling member 29 may be formed from a deformable member such as a string, a rope, a wire, a chain, and a belt. The coupling member 29 may be formed from a non-deformable member such as a plate, a rod, and a pipe and may be turnably fitted to the body 12 and to the liquid supply device 20.

Of the bellows tube 28, a first end 28*a* is fixed to the body 12 and a second end 28*b* is fixed to the liquid supply device 20. The liquid ejecting apparatus 10 may include a first fixing portion 31 to fix the first end 28*a* of the bellows tube 28 to the body 12 and a second fixing portion 32 to fix the second end 28*b* of the bellows tube 28 to the liquid supply device 20. The coupling member 29 may couple the first fixing portion 31 to the second fixing portion 32.

The liquid supply sources 23 and the supply flow channels 27 are provided so as to at least correspond to respective types of the liquids. Examples of the types of the liquids include inks containing coloring materials, storage liquids not containing coloring materials, process liquids that promote fixation of the inks, and so forth. The liquid ejecting apparatus 10 can perform color printing when the supply flow channels 27 supply color inks of different colors from one another.

Examples of colors of the color inks include cyan, magenta, yellow, black, white, and the like. The color printing may be carried out by using four colors of cyan, magenta, yellow, and black, or may be carried out by using three colors of cyan, magenta, and yellow. The color printing may be carried out by adding at least one of light cyan, light magenta, light yellow, orange, green, gray, and the like to the three colors of cyan, magenta, and yellow. Each of these inks may contain an antiseptic agent.

The white ink can be used for background printing before the color printing when printing on a medium M that is a transparent or translucent film or when printing on a medium M that has a dark color. The background printing is also referred to as solid printing or fill printing in some cases.

Figure 2:
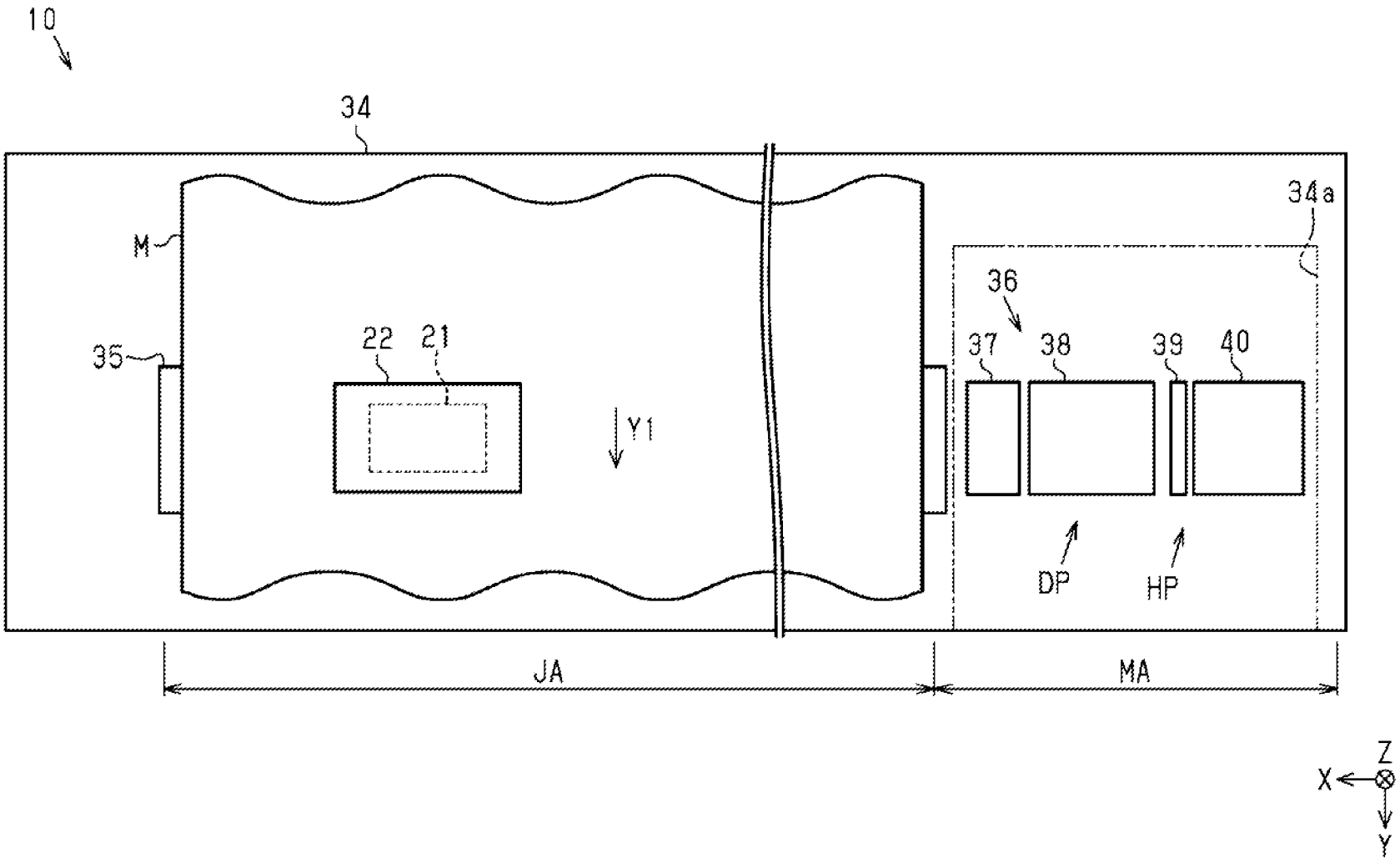
FIG. 2 is a plan view schematically showing a layout of constituents of the liquid ejecting apparatus.

As shown in FIG. 2, the carriage 22 is movably provided between an ejection area JA which is used to cause the liquid ejecting head 21 to eject the liquids onto the medium M and a maintenance area MA which is provided at a position adjacent to the ejection area JA and used to perform maintenance of the liquid ejecting head 21. The liquid ejecting apparatus 10 includes a housing 34 that surrounds the ejection area JA and the maintenance area MA.

The opening 34*a* is blocked by the maintenance cover 18 located at the closed position. In other words, the maintenance cover 18 located at the closed position covers the maintenance area MA. The maintenance cover 18 located at the open position exposes the maintenance area MA.

The liquid ejecting apparatus 10 includes a support portion 35 that is provided in the ejection area JA. The support portion 35 extends in the width direction X of the medium M and supports the medium M located at a printing position. In this embodiment, a transport direction Y1 of the medium M at the printing position is along the Y-axis. In other words, the depth direction Y coincides with the transport direction Y1 at the printing position.

The ejection area JA is an area where the liquid ejecting head 21 can eject the liquids onto the medium M having a maximum width. When the liquid ejecting apparatus 10 has a borderless printing function, the ejection area JA is an area that is slightly larger than the medium M having the maximum width.

The liquid ejecting apparatus 10 includes a maintenance unit 36 that is provided in the maintenance area MA. The maintenance unit 36 includes a liquid collection device 37, a wiping device 38, a suctioning device 39, and a capping device 40, which are arranged in this order starting from a position close to the ejection area JA. A position above the capping device 40 is defined as a home position HP for the liquid ejecting head 21. The home position HP defines a starting point of movement of the liquid ejecting head 21.

A detachment position DP is defined in the maintenance area MA. The detachment position DP is located above the wiping device 38 in this embodiment. The housing 34 includes the opening 34*a* which enables access to the carriage 22 that locates the liquid ejecting head 21 at the detachment position DP.

Figure 3:
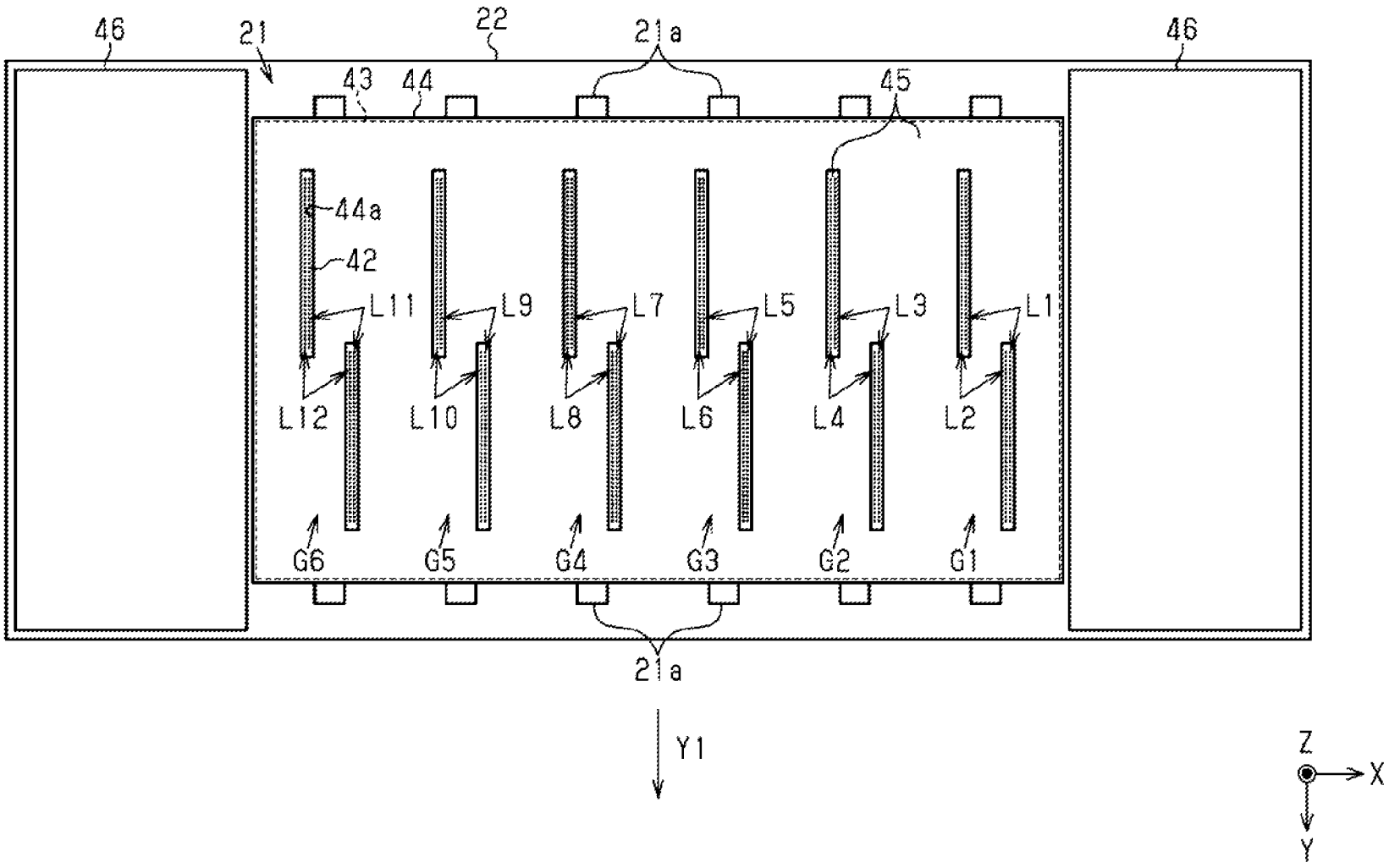
FIG. 3 is a schematic bottom view of a liquid ejecting head and a carriage.

As shown in FIG. 3, the liquid ejecting head 21 may include a nozzle forming member 43 in which nozzles 42 are formed, and a cover member 44 that covers part of the nozzle forming member 43. The cover member 44 is made of a metal such as stainless steel. The cover member 44 is provided with through holes 44*a* that penetrate the cover member 44 in the vertical direction Z. The cover member 44 covers a side of the nozzle forming member 43 where the nozzles 42 are formed in such a way as to expose nozzles 42 from the through holes 44*a*. A nozzle surface 45 includes the nozzle forming member 43 and the cover member 44. To be more precise, the nozzle surface 45 is formed from the nozzle forming member 43 exposed from the through holes 44*a* and from the cover member 44, and the nozzles 42 for ejecting the liquids are formed therein.

Numerous openings of the nozzles 42 to eject the liquids are arranged in one direction at regular intervals in the liquid ejecting head 21. The nozzles 42 constitute nozzle lines. In this embodiment, the openings of the nozzles 42 are arranged in the transport direction Y1 and constitute first to twelfth nozzle lines L1 to L12. The nozzles 42 that constitute one nozzle line eject the liquid of the same type. Of the nozzles 42 constituting one nozzle line, the nozzles 42 located upstream in the transport direction Y1 are formed in such a way as to be displaced in the width direction X from the nozzles 42 located downstream in the transport direction Y1.

Every two lines out of the first to twelfth nozzle lines L1 to L12 are arranged close to each other in the width direction X. In this embodiment, the two nozzle lines arranged close to each other will be referred to as a nozzle group. In the liquid ejecting head 21, first to sixth nozzle groups G1 to G6 are arranged at regular intervals in the width direction X.

Specifically, the first nozzle group G1 includes the first nozzle line L1 that ejects magenta ink and the second nozzle line L2 that ejects yellow ink. The second nozzle group G2 includes the third nozzle line L3 that ejects cyan ink and the fourth nozzle line L4 that ejects black ink. The third nozzle group G3 includes the fifth nozzle line L5 that ejects light cyan ink and the sixth nozzle line L6 that ejects light magenta ink. The fourth nozzle group G4 includes the seventh nozzle line L7 and the eighth nozzle line L8 that eject process liquids. The fifth nozzle group G5 includes the ninth nozzle line L9 that ejects black ink and the tenth nozzle line L10 that ejects cyan ink. The sixth nozzle group G6 includes the eleventh nozzle line L11 that ejects yellow ink and the twelfth nozzle line L12 that ejects magenta ink.

The liquid ejecting head 21 is provided with projections 21*a* that project to two sides in the transport direction Y1. Among the projections 21*a*, two of the projections 21*a* located at the same position in the width direction X form a pair. The pairs of projections 21*a* thus formed are arranged in the width direction X at the same intervals as the nozzle groups.

The liquid ejecting apparatus 10 may include air flow stabilizing portions 46 held at a lower part of the carriage 22. Installation of the air flow stabilizing portions 46 on two sides in the width direction X of the liquid ejecting head 21 facilitates stabilization of airflow around the liquid ejecting head 21 that reciprocates along the X-axis.

Figure 4:
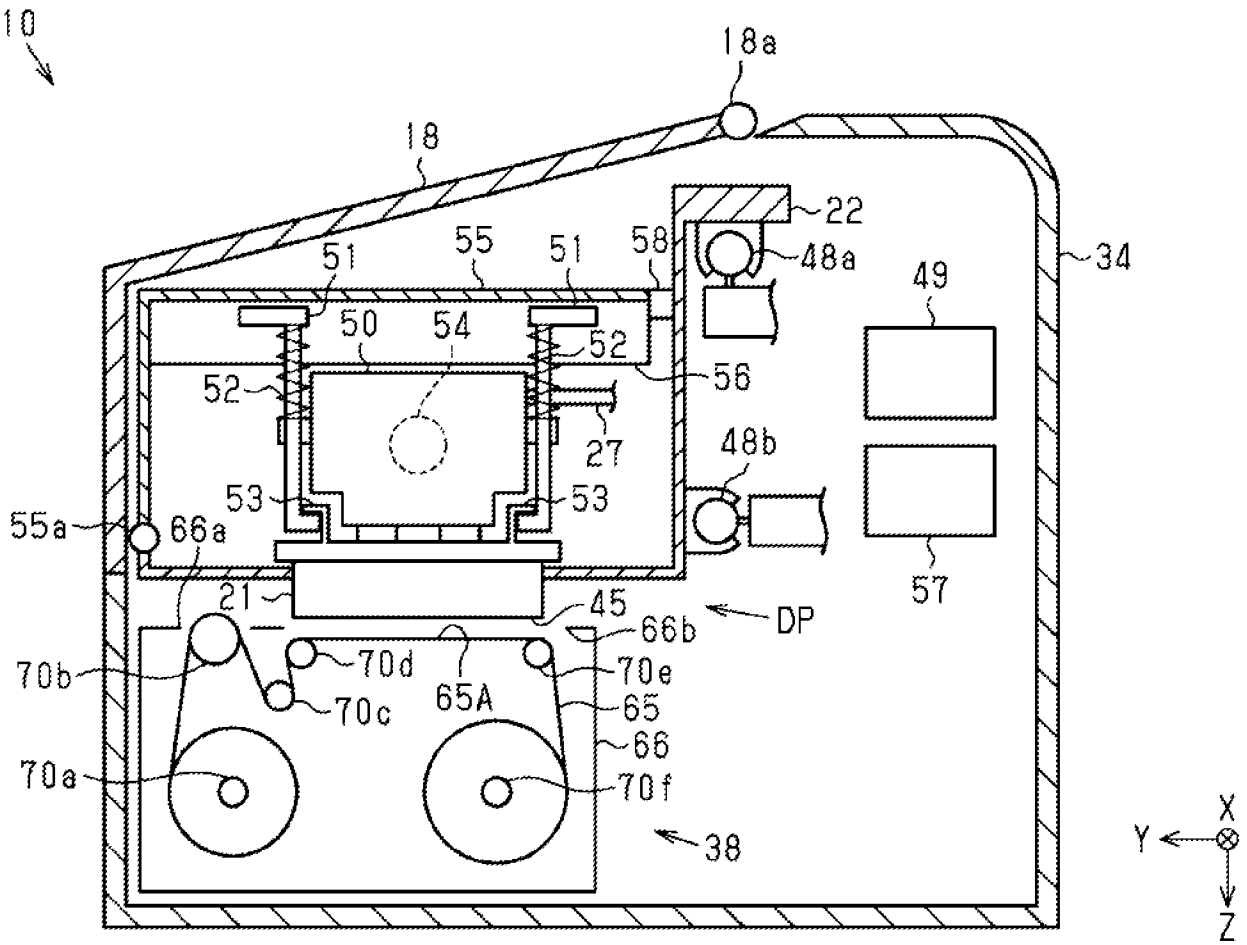
FIG. 4 is a side view schematically showing more constituents of the liquid ejecting apparatus.

As shown in FIG. 4, the liquid ejecting apparatus 10 includes a first guide shaft 48*a* and a second guide shaft 48*b* which support the carriage 22, and a carriage movement mechanism 49 that moves the carriage 22. The first guide shaft 48*a* and the second guide shaft 48*b* extend in the width direction X. The carriage 22 reciprocates along the first guide shaft 48*a* and the second guide shaft 48*b* by driving of the carriage movement mechanism 49.

The liquid ejecting apparatus 10 includes a liquid supply coupling portion 50 detachably coupled to the liquid ejecting head 21 so as to supply the liquids to the liquid ejecting head 21, fixation members 51 held by the liquid supply coupling portion 50, and springs 52 that push up the fixation members 51. The fixation members 51 can be located at fixation positions shown in FIG. 4 where the liquid supply coupling portion 50 is coupled to the liquid ejecting head 21 and fixed to the carriage 22, and at release positions shown in FIG. 12 where the fixation is released. The liquid supply coupling portion 50 and the liquid ejecting head 21 which are mounted on the carriage 22 are detachable from the carriage 22 when the fixation members 51 are located at the release positions. The fixation members 51 located at the fixation positions are pushed against engagement portions 53 by the springs 52, thus fixing the liquid supply coupling portion 50.

Tubes constituting the supply flow channels 27 are coupled to the liquid supply coupling portion 50. The liquids are supplied to the liquid ejecting head 21 through the liquid supply coupling portion 50. The liquid supply coupling portion 50 includes differential pressure regulating valves 54. The differential pressure regulating valves 54 are so-called pressure reducing valves. Specifically, such a differential pressure regulating valve 54 is opened when a pressure of the liquid present between the differential pressure regulating valve 54 and the liquid ejecting head 21 falls below a predetermined negative pressure that is lower than an atmospheric pressure as a consequence of consumption of the liquid in the liquid ejecting head 21. In this case, the differential pressure regulating valve 54 allows the liquid to flow from the liquid supply coupling portion 50 to the liquid ejecting head 21.

The differential pressure regulating valve 54 is closed when the pressure of the liquid present between the differential pressure regulating valve 54 and the liquid ejecting head 21 regains the predetermined negative pressure as a consequence of the flow of the liquid from the liquid supply coupling portion 50 to the liquid ejecting head 21. In this case, the differential pressure regulating valve 54 stops the flow of the liquid directed from the liquid supply coupling portion 50 to the liquid ejecting head 21. The differential pressure regulating valve 54 is never opened even when the pressure of the liquid present between the differential pressure regulating valve 54 and the liquid ejecting head 21 becomes higher. Accordingly, the differential pressure regulating valve 54 functions as a one-way valve or so-called a stop valve that allows the flow of the liquid from the liquid supply coupling portion 50 to the liquid ejecting head 21 and blocks the flow of the liquid from the liquid ejecting head 21 to the liquid supply coupling portion 50.

The liquid ejecting apparatus 10 includes a carriage cover 55 openably and closably provided to the carriage 22. The carriage cover 55 is provided with a contact portion 56 which comes into contact with the fixation members 51 when the carriage cover 55 is located at a position different from the closed position in a case in which the fixation members 51 are located at the release positions. The contact portion 56 of this embodiment is a rib being provided on a lower surface of the carriage cover 55 located at the closed position and extending in the depth direction Y.

Figure 9:
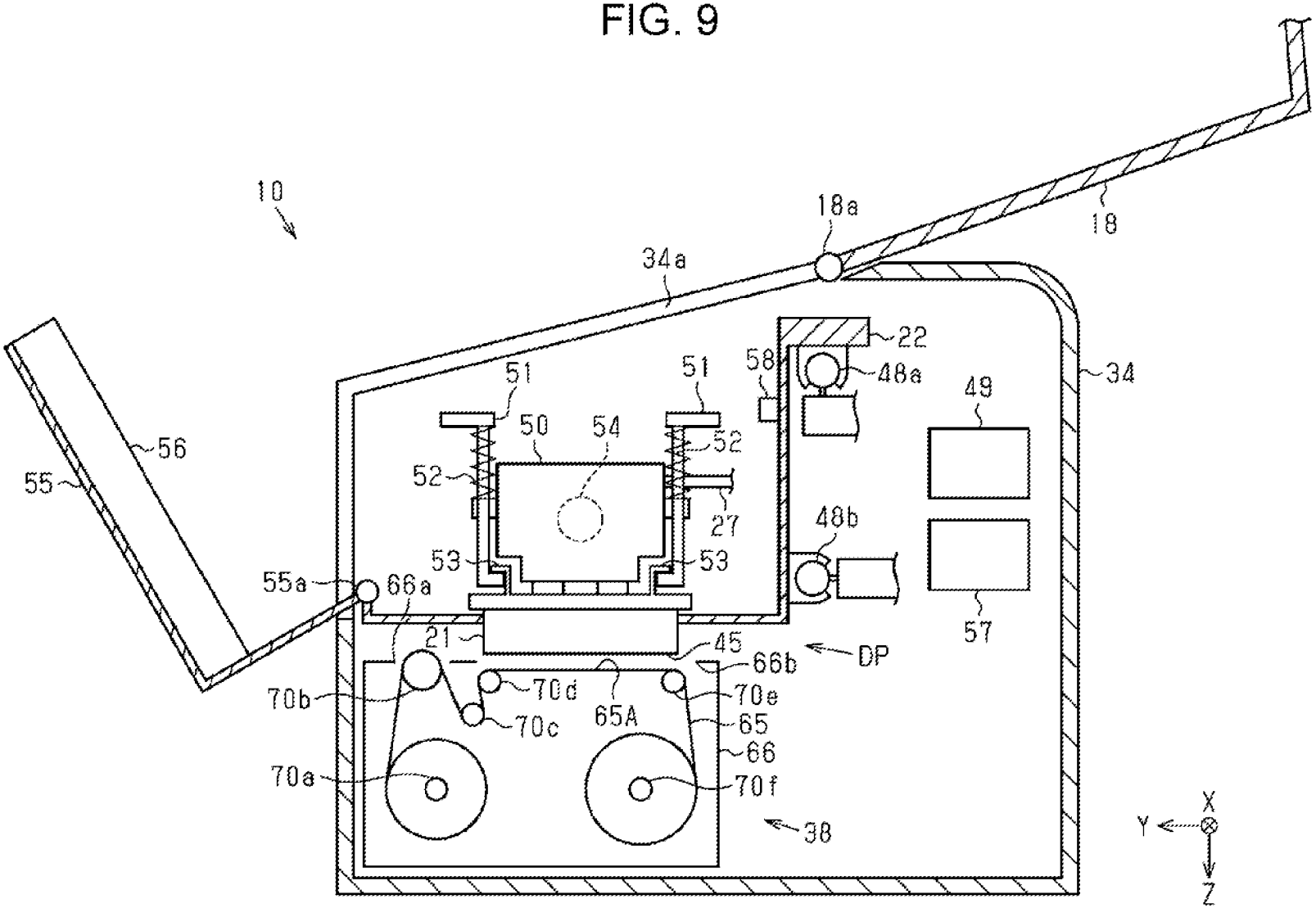
FIG. 9 is a schematic side view of the liquid ejecting apparatus in which a carriage cover is located at an open position.

The carriage cover 55 may be fitted to the carriage 22 turnably around a second shaft 55*a* between the closed position shown in FIG. 4 and the open position shown in FIG. 9. The second shaft 55*a* extends in the width direction X at an end in front of the carriage cover 55 in terms of the depth direction Y. The closed position is a position where the carriage cover 55 covers at least part of the carriage 22 and of the liquid supply coupling portion 50. The carriage cover 55 is located at the closed position when the liquid ejecting head 21 ejects the liquids to print the medium M, thus covering an upper part of the carriage 22.

The open position of the carriage cover 55 is a position where an operator is allowed to access the liquid supply coupling portion 50. The carriage cover 55 is turnable between the closed position and the open position in the state where the carriage 22 locates the liquid ejecting head 21 at the detachment position DP. When detaching the liquid supply coupling portion 50, the carriage movement mechanism 49 moves the carriage 22 in such a way as to move the liquid ejecting head 21 to the detachment position DP. The liquid supply coupling portion 50 becomes detachable when the carriage cover 55 is located at the open position in the state where the liquid ejecting head 21 is located at the detachment position DP.

The liquid ejecting apparatus 10 includes a control portion 57 that controls various operations executed by the liquid ejecting apparatus 10 and a sensor 58 that can detect the carriage cover 55 located at the closed position. The control portion 57 is formed from a computer and a processing circuit and the like inclusive of a memory, and controls the liquid ejecting head 21, the carriage movement mechanism 49, and the like in accordance with programs stored in the memory.

Figure 5:
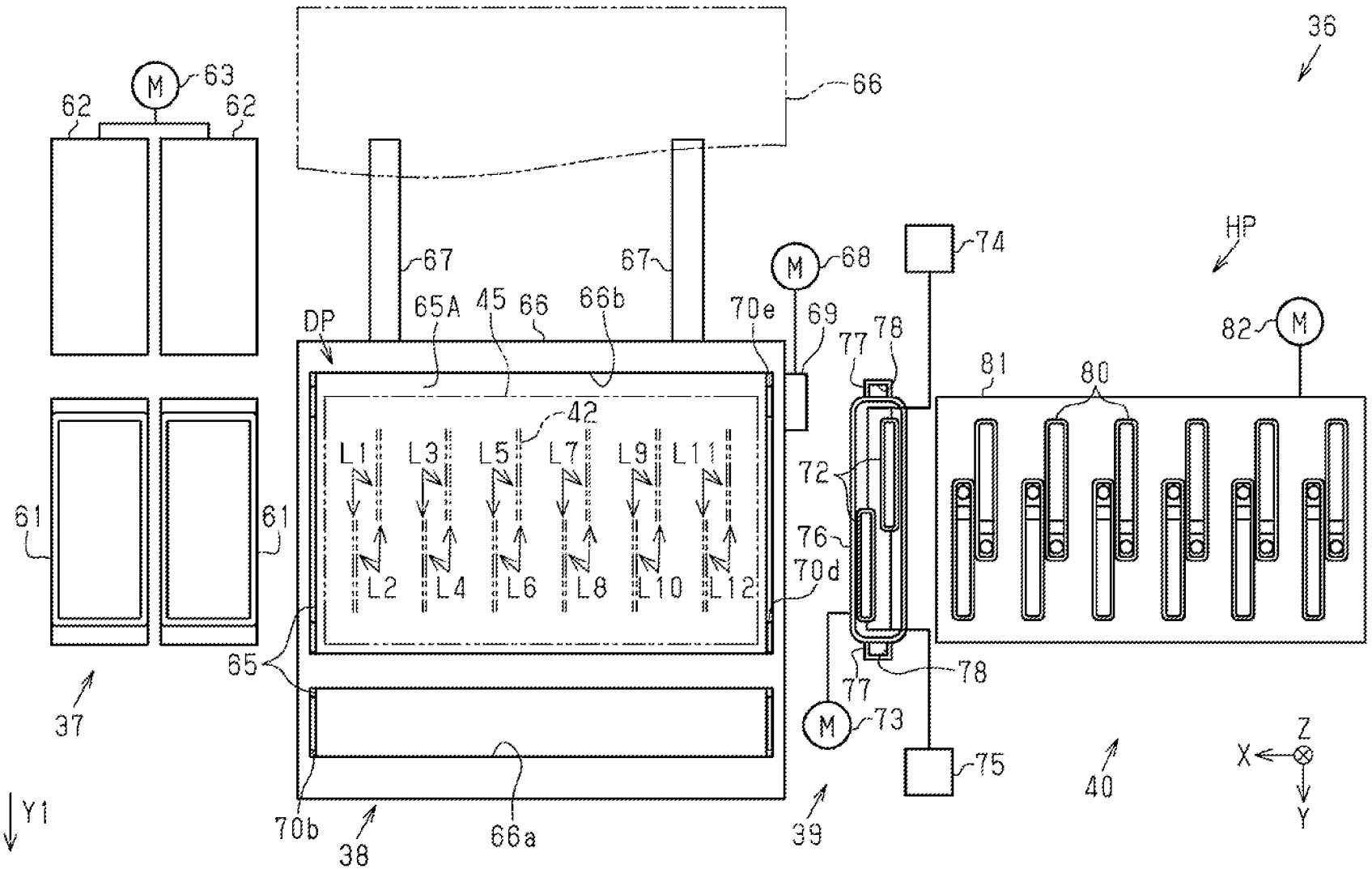
FIG. 5 is a schematic plan view of a maintenance unit.

As shown in FIG. 5, the liquid collection device 37 collects the liquids discharged from the nozzles 42 for the purpose of maintenance of the liquid ejecting head 21. The liquid ejecting head 21 ejects the liquids as waste fluids in order to prevent and resolve clogging of the nozzles 42. This maintenance is called flushing.

The liquid collection device 37 includes a liquid receiving portion 61 to receive the liquids ejected from the liquid ejecting head 21 for the flushing, a lid member 62 for covering an opening of the liquid receiving portion 61, and a lid motor 63 that moves the lid member 62. The liquid collection device 37 may include two or more liquid receiving portions 61 and two or more lid member 62. The liquid ejecting head 21 may select the liquid receiving portions 61 depending on the types of the liquids. In this embodiment, liquid receiving portion 61 located near the ejection area JA receives the color inks ejected from the liquid ejecting head 21 for the purpose of flushing while the liquid receiving portion 61 located near the wiping device 38 receives the process liquids ejected from the liquid ejecting head 21 for the purpose of flushing. Meanwhile, the liquid receiving portion 61 may store a moisturizing agent.

By means of the lid motor 63, the lid member 62 moves between a covering position to cover the opening of the liquid receiving portion 61 and an exposing position to expose the opening of the liquid receiving portion 61. When the flushing does not take place, the lid member 62 moves to the covering position to suppress drying of the stored moisturizing agent and received liquids.

As shown in FIG. 5, the wiping device 38 includes a sheet-like belt-like member 65 that wipes the liquid ejecting head 21, a case 66 that houses the belt-like member 65, a pair of rails 67 that extend in the transport direction Y1, and a wiping motor 68 that moves the case 66. A power transmission mechanism 69 that transmits power of the wiping motor 68 is provided to the case 66. The power transmission mechanism 69 is formed from a rack-and-pinion mechanism, for example. The case 66 reciprocates on the rails 67 along the Y-axis by using the power from the wiping motor 68.

As shown in FIGS. 4 and 5, the case 66 rotatably supports a reel-out shaft 70*a*, a pressure roller 70*b*, first to third driven rollers 70*c* to 70*e*, and a roll-up shaft 70*f*. The case 66 is provided with a first opening 66*a* that exposes a portion of a belt-like member 65 wound around the pressure roller 70*b*, and a second opening 66*b* that exposes a portion of the belt-like member 65 located between the second driven roller 70*d* and the third driven roller 70*e*. The reel-out shaft 70*a* reels out the belt-like member 65 while the roll-up shaft 70*f* rolls up the used belt-like member 65. The pressure roller 70*b* pushes up the belt-like member 65 reeled out of the reel-out shaft 70*a*, thereby causing the belt-like member 65 to protrude from the first opening 66*a*.

The case 66 moves downstream in the transport direction Y1 from an upstream position indicated with a chain double-dashed line in FIG. 5 and reaches a downstream position indicated with a solid line in FIG. 5 by forward rotation of the wiping motor 68. Then, the case 66 moves from the downstream position to the upstream position by reverse rotation of the wiping motor 68. The belt-like member 65 may perform wiping of the liquid ejecting head 21 at least in any one of the process of the movement of the case 66 from the upstream position to the downstream position and the process of the movement of the case 66 from the downstream position to the upstream position. The wiping is maintenance work of wiping the nozzle surface 45 with the belt-like member 65.

The wiping device 38 wipes the nozzle surface 45 by bringing the belt-like member 65 into contact with the nozzle surface 45 in such a way that the pressure roller 70*b* presses the belt-like member 65 against the nozzle surface 45. In other words, the case 66 moves in the state of sandwiching the belt-like member 65 between the pressure roller 70*b* and the nozzle surface 45, and the wiping device 38 thus wipes the nozzle surface 45.

When the case 66 is located at the downstream position and the liquid ejecting head 21 is located at the detachment position DP, the belt-like member 65 exposed from the second opening 66*b* while being supported by the second driven roller 70*d* and the third driven roller 70*e* is opposed to the nozzle surface 45. Accordingly, the portion of the belt-like member 65 exposed from the second opening 66*b* serves as a liquid receiving portion 65A that is opposed to the nozzle surface 45 located at the detachment position DP and receives the liquids discharged from the nozzles 42.

The liquid receiving portion 65A is formed by drawing out the belt-like member 65 such that the belt-like member 65 is opposed to the nozzle surface 45 located at the detachment position DP. To be more precise, the belt-like member 65 is supported by the reel-out shaft 70*a* in the form of a rolled body wound into a roll. The liquid receiving portion 65A is formed by reeling out the belt-like member 65 from the rolled body, then sequentially wrapping the belt-like member 65 around the pressure roller 70*b*, the first driven roller 70*c*, and the second driven roller 70*d* in this order, and drawing the belt-like member 65 to the third driven roller 70*e* along a horizontal plane.

A distance in the transport direction Y1 from the center of the third driven roller 70*e* to the center of the second driven roller 70*d* is equal to or larger than the size of a region where the nozzles 42 are formed. In other words, the size of a planar portion of the belt-like member 65 in the transport direction Y1 is equal to or larger than a distance from the nozzle 42 located most upstream to the nozzle 42 located most downstream.

As shown in FIG. 5, a width of the belt-like member 65 in the width direction X is equal or larger than the size of the region where the nozzles 42 are formed. In other words, the width of the belt-like member 65 is equal to or larger than a width from the nozzle 42 that constitutes part of the first nozzle line L1 and is located downstream in the transport direction Y1 to the nozzle 42 that constitutes part of the twelfth nozzle line L12 and is located upstream in the transport direction Y1.

When the liquid receiving portion 65A has the size equal to or larger than the nozzle surface 45, the liquid receiving portion 65A is likely to receive a liquid more easily even when such a liquid leaks out of any of the nozzles 42 and runs down along the nozzle surface 45. In this regard, the second opening 66*b* and the belt-like member 65 may have a width equal to or larger than the nozzle surface 45 in the width direction X. The second opening 66*b* may have a depth equal to or larger than the nozzle surface 45 in the depth direction Y.

The liquid ejecting apparatus 10 may perform pressure cleaning by discharging the pressurized liquids from the nozzles 42 in the state where the liquid ejecting head 21 is located at the detachment position DP and the belt-like member 65 is opposed to the nozzle surface 45. In other words, the belt-like member 65 may receive the liquids discharged in the course of the pressure cleaning.

As shown in FIGS. 4 and 5, the power transmission mechanism 69 may uncouple the wiping motor 68 from the roll-up shaft 70*f* when the wiping motor 68 rotates forward and couple the wiping motor 68 to the roll-up shaft 70*f* when the wiping motor 68 rotates in reverse. The roll-up shaft 70*f* may be rotated by the power originating from the reverse rotation of the wiping motor 68. The roll-up shaft 70*f* may roll up the belt-like member 65 when the case 66 moves from the downstream position to the upstream position.

As shown in FIG. 5, the suctioning device 39 includes suction caps 72 and a suction motor 73 that causes the suction caps 72 to reciprocate along the Z-axis. The suctioning device 39 includes a cleaning liquid supply mechanism 74 that supplies a cleaning liquid into the suction caps 72, and a discharge mechanism 75 that discharges the liquids inside the suction caps 72.

When the liquids ejected from the liquid ejecting head 21 are aqueous inks, the cleaning liquid may be purified water or water containing additives such as an antiseptic agent, a surfactant, and the moisturizing agent. Meanwhile, the cleaning liquid may be a solvent when the liquids ejected from the liquid ejecting head 21 are solvent inks.

Such a suction cap 72 may be configured to surround all the nozzles 42 in a lump, configured to surround at least one nozzle group, or configured to surround some of the nozzles 42 constituting a nozzle group. The suctioning device 39 of this embodiment includes the suction cap 72 corresponding to the nozzles 42 out of the nozzles 42 constituting one nozzle group which are located upstream in the transport direction Y1 and the suction cap 72 corresponding to the rest of the nozzles 42 located downstream in the transport direction Y1. The suctioning device 39 may include a tub 76 that houses the two suction caps 72. Projections 77 may be provided on two ends in the transport direction Y1 of the tub 76. The projections 77 may be provided with positioning portions 78 of which upper parts are opened and recessed.

The suction motor 73 moves the suction caps 72 and the tub 76 between a contact position and a retreat position. The contact position is a position where the suction caps 72 come into contact with the liquid ejecting head 21. The retreat position is a position where the suction caps 72 retreats from the liquid ejecting head 21.

When the suction motor 73 moves the suction caps 72 and the tub 76 located at the retreat position to the contact position, the projections 21*a* of the liquid ejecting head 21 are inserted into the positioning portions 78 of the suctioning device 39. The suction caps 72 are positioned in the width direction X and in the depth direction Y as a consequence of engagement of the projections 21*a* with the positioning portions 78.

Figure 6:
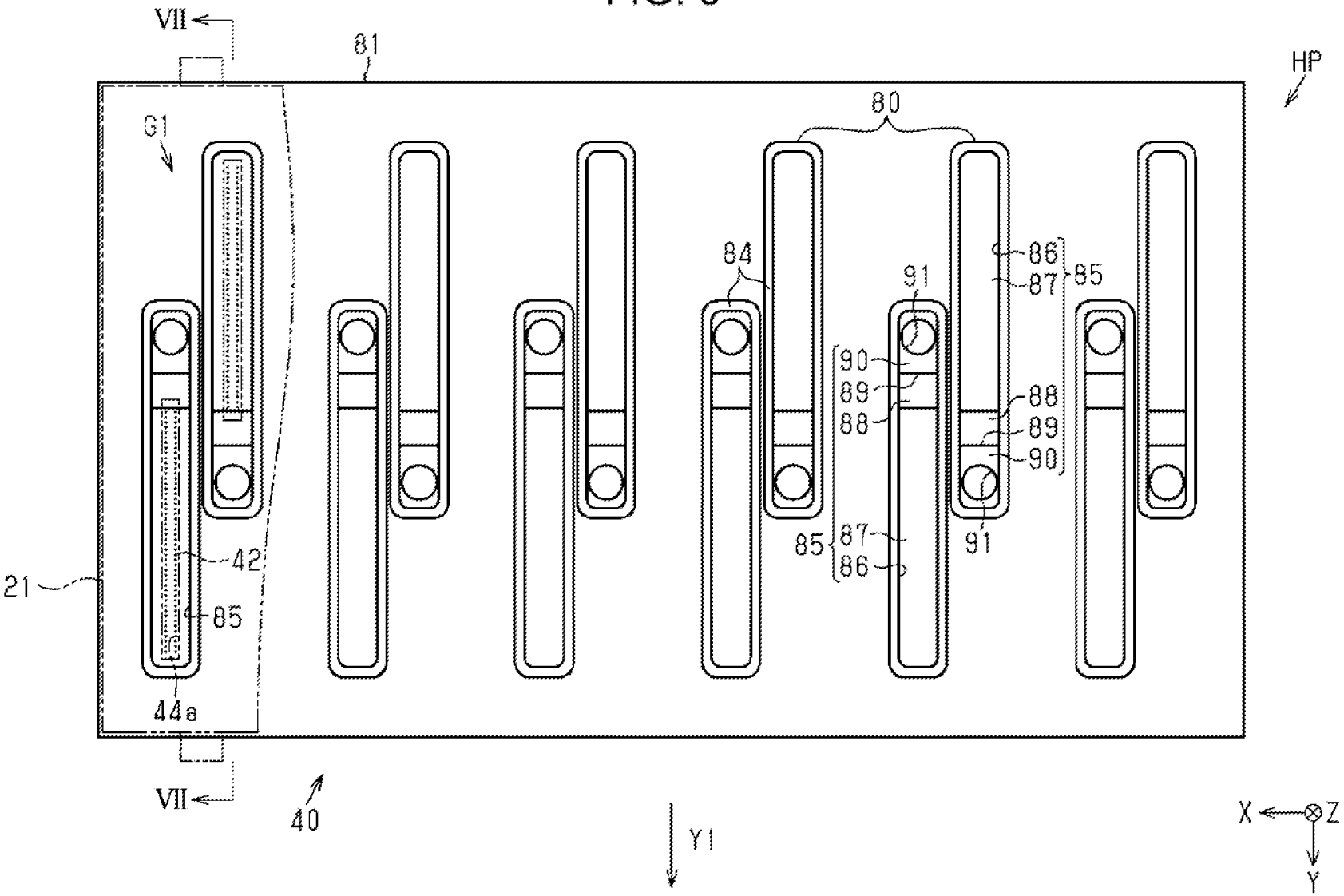
FIG. 6 is a schematic plan view of a capping device.

As shown in FIGS. 5 and 6, the capping device 40 includes stand-by caps 80, a stand-by holder 81, and a stand-by motor 82 that causes the stand-by holder 81 to reciprocate along the Z-axis. When the stand-by motor 82 moves the stand-by holder 81 up and down, the stand-by caps 80 are moved up and down accordingly. Such a stand-by cap 80 moves from a separated position shown in FIG. 7 to a capping position shown in FIG. 8 and comes into contact with the nozzle surface 45 of the liquid ejecting head 21 which is stopped at the home position HP.

The stand-by caps 80 located at the capping positions cover the openings of the nozzles 42 that constitute the first to sixth nozzle groups G1 to G6. The above-described maintenance of causing the stand-by caps 80 to surround the openings of the nozzles 42 is referred to as stand-by capping. The stand-by capping is one of capping operations. The stand-by capping inhibits the nozzles 42 from getting dried.

Such a stand-by cap 80 may be configured to surround all the nozzles 42 in a lump, configured to surround at least one nozzle group, or configured to surround some of the nozzles 42 constituting a nozzle group. The capping device 40 of this embodiment includes twelve stand-by caps 80. Each stand-by cap 80 corresponds to the nozzles 42 out of the nozzles 42 constituting one nozzle group which are located upstream in the transport direction Y1, or to the rest of the nozzles 42 located downstream in the transport direction Y1. Though the stand-by cap 80 located upstream in the transport direction Y1 and the stand-by cap 80 located downstream in the transport direction Y1 are oriented differently from each other, these caps have the same configuration.

As shown in FIG. 6, each stand-by cap 80 includes an annular lip portion 84 that can come into contact with the nozzle surface 45, and a recessed portion 85 that uses the lip portion 84 as an upper end and is recessed inward from the lip portion 84. An opening area of the recessed portion 85 is larger than an opening area of the through holes 44*a*. For this reason, when the stand-by cap 80 is located at the capping position, the lip portion 84 comes into contact with the nozzle surface 45 formed from the cover member 44.

The recessed portion 85 may include an outer peripheral wall 86, an inclined side wall 87, an inner bottom wall 88, a side wall 89, and an air communication wall 90. At least one wall out of the inner bottom wall 88, the air communication wall 90, the side wall 89, and the inclined side wall 87 which collectively form the recessed portion 85, at least part of the outer peripheral wall 86, and the lip portion 84 may be integrally formed from an elastic member. The outer peripheral wall 86, the inclined side wall 87, the inner bottom wall 88, the side wall 89, and the air communication wall 90 are provided visibly from the opening side of the recessed portion 85 that adopts the lip portion 84 as a rim.

The outer peripheral wall 86 is a wall which is linked to the lip portion 84 and forms the opening of the recessed portion 85. The outer peripheral wall 86 surrounds the inclined side wall 87, the inner bottom wall 88, the side wall 89, and the air communication wall 90. The outer peripheral wall 86 crosses the inclined side wall 87, the inner bottom wall 88, the side wall 89, and the air communication wall 90 at a position below the lip portion 84.

The air communication wall 90 is provided with a communication port 91 directed toward the opening of the recessed portion 85. In other words, the communication port 91 is formed visibly from the opening of the recessed portion 85 when the opening of the recessed portion 85 is not covered. The air communication wall 90 is provided at a position which is closer to the opening of the recessed portion 85 than to the inner bottom wall 88.

When two or more stand-by caps 80 are provided, the stand-by caps 80 are provided such that the communication ports 91 are located at positions near the center in the transport direction Y1. This makes it easier to clean the surroundings of the communication ports 91. In this embodiment, of the two stand-by caps 80 that cover one nozzle group, the stand-by cap 80 located upstream in the transport direction Y1 is arranged such that its air communication wall 90 is located downstream in the transport direction Y1 relative to its inner bottom wall 88. Meanwhile, the stand-by cap 80 located downstream in the transport direction Y1 is arranged such that its air communication wall 90 is located upstream in the transport direction Y1 relative to its inner bottom wall 88. The stand-by caps 80 may be arranged such that the inclined side walls 87 are located at positions vertically below the nozzles 42.

Figure 7:
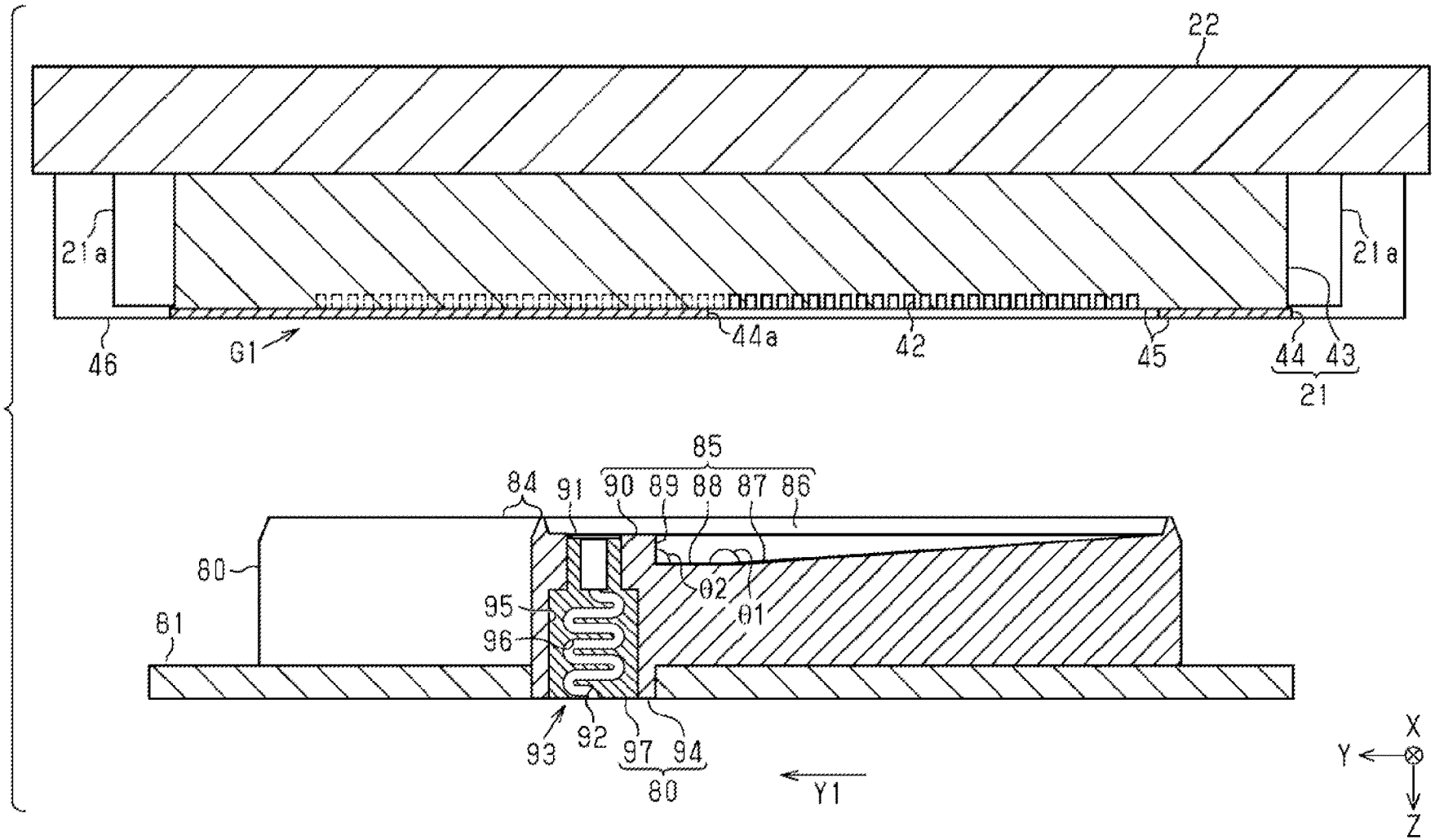
FIG. 7 is a schematic cross-sectional view taken along and viewed in a direction of VII-VII arrows in FIG. 6.

As shown in FIG. 7, the inner bottom wall 88 is located between the side wall 89 and the inclined side wall 87 in the transport direction Y1. The air communication wall 90, the side wall 89, and the inclined side wall 87 are located between the inner bottom wall 88 and the lip portion 84 in the transport direction Y1.

The outer peripheral wall 86 joins the inner bottom wall 88, the air communication wall 90, the side wall 89, and the inclined side wall 87 to the lip portion 84 in the vertical direction Z. The side wall 89 is located between the air communication wall 90 and the inner bottom wall 88 in the transport direction Y1, and joins the air communication wall 90 to the inner bottom wall 88. The lip portion 84, the air communication wall 90, and the inner bottom wall 88 may be continuously provided in a stepped fashion. The inclined side wall 87 may join the inner bottom wall 88 to the lip portion 84 without interposing the air communication wall 90 in-between.

The inner bottom wall 88 is provided away vertically downward from the opening of the recessed portion 85 as compared to the air communication wall 90, the side wall 89, and the inclined side wall 87. An inclination of the inner bottom wall 88 relative to the horizontal plane is smaller than an inclination of the inclined side wall 87 relative to the horizontal plane. The inner bottom wall 88 of this embodiment is formed in line with the horizontal plane. A first inner angle θ1 formed between the inclined side wall 87 and the inner bottom wall 88 is larger than a second inner angle θ2 formed between the side wall 89 and inner bottom wall 88.

Each stand-by cap 80 includes an air communication portion 93 that establishes communication between the communication port 91 formed inside the recessed portion 85 and an open port 92 formed outside the recessed portion 85. The air communication portion 93 may be formed by providing a cap member 94 and fitting a rigid member 97 having a groove 96 on its side surface into an insertion hole 95 formed in the cap member 94. The air communication portion 93 may be formed by blocking the groove 96 with an inner surface of the insertion hole 95. A width of the groove 96 may be set smaller than a diameter of the communication port 91. The groove 96 may be formed in a meandering manner. The air communication portion 93 is provided at a position more distant from the opening of the recessed portion 85 than the communication port 91 is.

Figure 8:
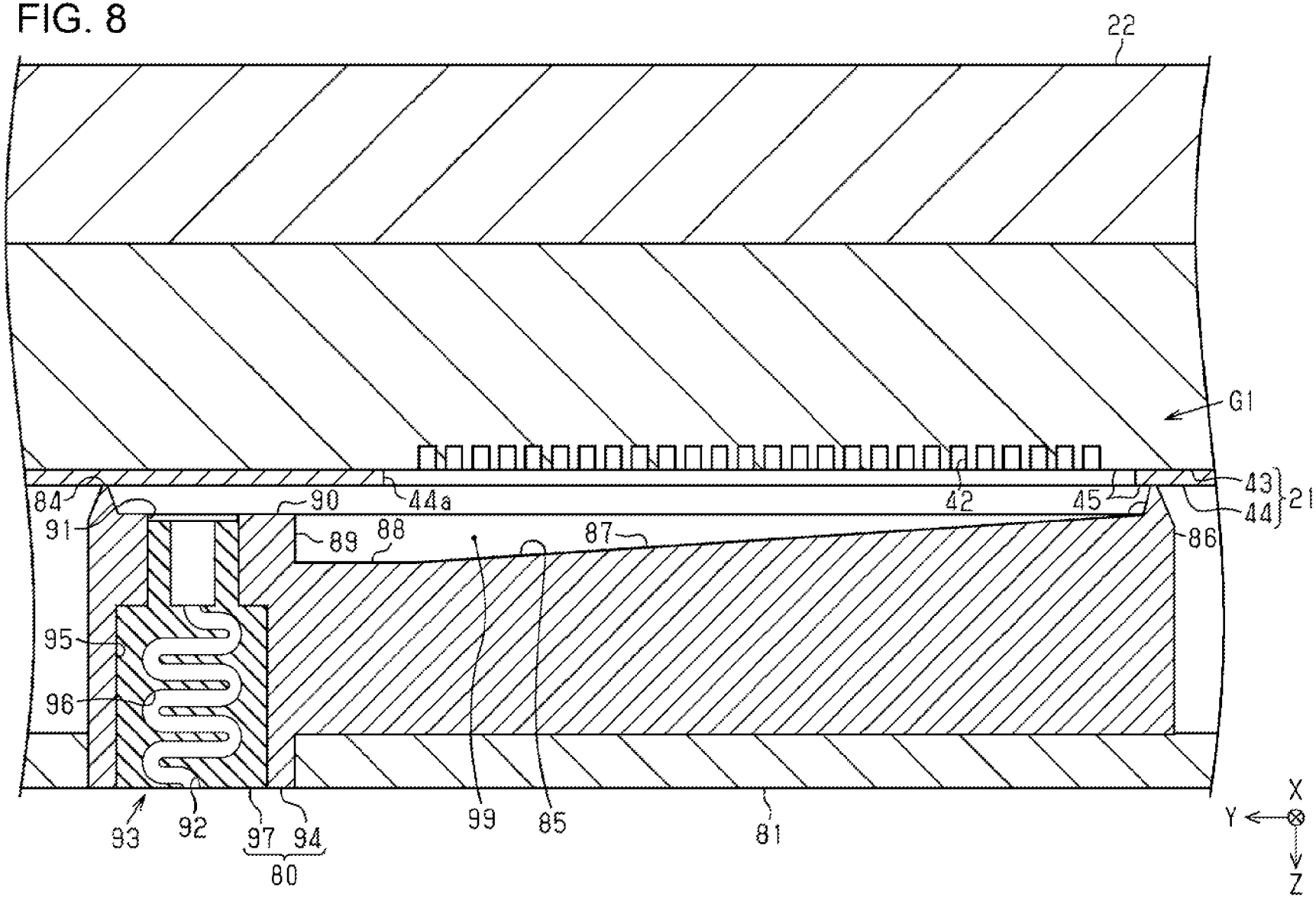
FIG. 8 is a schematic cross-sectional view of a stand-by cap located at a capping position.

As shown in FIG. 8, in the stand-by cap 80 located at the capping position, the lip portion 84 is in contact with the nozzle surface 45 and the nozzle surface 45 of the liquid ejecting head 21 covers the opening of the recessed portion 85. In this state of capping, the communication port 91 formed toward the opening of the recessed portion 85 is opposed to the nozzle surface 45. When the stand-by cap 80 is located at the capping position, a space 99 including the nozzles 42 is formed by the recessed portion 85 in conjunction with the liquid ejecting head 21. The space 99 is made open to the atmosphere by the air communication portion 93.

While the stand-by cap 80 is located at the capping position, the lip portion 84 is in contact with the nozzle surface 45, thus forming the space 99. In the state where the space 99 is formed, the air communication wall 90 may be opposed to the cover member 44. In the state where the lip portion 84 is in contact with the nozzle surface 45, the communication port 91 may be formed at a position different from the position located vertically below the nozzles 42. The air communication wall 90, the side wall 89, and the inner bottom wall 88 may be located at positions different from the position immediately below the nozzles 42.

Next, a description will be given of liquid repellent characteristics.

Liquid repellent characteristics may vary among the nozzle surface 45, the suction cap 72, and the stand-by caps 80. As for the nozzle surface 45, the liquid repellent characteristics may vary between a portion formed from the nozzle forming member 43 and a portion formed from the cover member 44. For example, the portion of the nozzle surface 45 formed from the nozzle forming member 43 may have higher liquid repellency than that of the portion of the nozzle surface 45 formed from the cover member 44. When placed in order from highest to lowest liquid repellency or from lowest to highest wettability, this embodiment includes the portion of the nozzle surface 45 formed from the nozzle forming member 43, the suction caps 72, the stand-by caps 80, and the portion of the nozzle surface 45 formed from the cover member 44.

The portion of the nozzle surface 45 formed from the nozzle forming member 43 may be subjected to a liquid repellent treatment. A contact angle formed between the portion of the nozzle surface 45 formed from the nozzle forming member 43 and a droplet of an ink as an example of the liquid may have an angle equal to or above 90 degrees. The liquid repellent treatment may be conducted to form a thin foundation layer mainly from polyorganosiloxane containing an alkyl group, and a liquid repellent film layer from a metal alkoxide having a fluorine-containing long-chain polymer group.

The cover member 44 may be formed from stainless steel while being spared from the liquid repellent treatment. A contact angle formed between the portion of the nozzle surface 45 formed from the cover member 44 and the ink droplet may have an angle below 50 degrees.

The suction caps 72 may be formed from a fluorine-based elastomer having liquid repellency. Examples of the fluorine-based elastomer include SHIN-ETSU SIFEL (a registered trademark) manufactured by Shin-Etsu Chemical Co., Ltd., Kalrez (a registered trademark) manufactured by DuPont de Nemours, Inc., and so forth. Each suction cap 72 may be provided with the liquid repellency by using the fluorine-based elastomer for forming the lip portion that comes into contact with the nozzle surface 45 when located at the contact position, and forming the recess that defines the space with the nozzle surface 45. A contact angle formed between the surface made of the fluorine-based elastomer and the ink droplet is about 60 degrees. The surfaces of the lip portion of the suction cap 72 and of the recess may be subjected to mirror finishing and thus inhibited from deterioration in liquid repellency owing to irregularities on the surfaces. The mirror finishing may be set to surface roughness Ra equal to or below 2.0 according to arithmetical mean roughness as defined by JIS B 0601 of Japanese Industrial Standards, for example.

The stand-by caps 80 may be formed from a styrene-based elastomer having lower liquid repellency and higher wettability than the fluorine-based elastomer. Examples of the styrene-based elastomer include LEOSTOMER (a registered trademark) manufactured by Riken Technos Corp. and so forth. In each stand-by cap 80, the lip portion 84 and the recessed portion 85 may be made of the styrene-based elastomer. A contact angle formed between the surface made of the styrene-based elastomer and the ink droplet is smaller than 60 degrees.

Liquids that scatter along with the ejection from the nozzles 42 or liquids leaking out of the nozzles 42 may go into the stand-by caps 80. Those liquids may contain glycerin such as in the case of the inks. If the stand-by cap 80 with the inks inside comes into contact with the nozzle surface 45 and forms the space 99, glycerin may absorb water from the inks and increase viscosity of the inks inside the nozzles 42. In this regard, the stand-by cap 80 may discharge the liquid adhering to the recessed portion 85 to the outside by taking advantage of wettability of the recessed portion 85.

To be more precise, the stand-by cap 80 may discharge the liquid by use of a rise-up phenomenon of the liquid. The liquid adhering to a surface with high wettability spreads along the surface and moves upward in the vertical direction Z as well. The stand-by cap 80 has higher wettability than that of the suction cap 72. The nozzle surface 45 to come into contact with the lip portion 84 has higher wettability than that of the stand-by cap 80. The liquid adhering to the inside of the stand-by cap 80 spreads and moves to the nozzle surface 45 in contact with the lip portion 84. In this way, the liquid can be discharged from the inside of the stand-by cap 80. After the capping with the stand-by cap 80 is released, the wiping device 38 may wipe the nozzle surface 45 to wipe off the liquid that moved onto the nozzle surface 45.

The stand-by cap 80 may have different liquid repellent characteristics depending on the walls that constitute the recessed portion 85. The liquid repellent characteristics may be made different by changing roughnesses among the surfaces. For example, a contact angle formed between the surface of the inclined side wall 87 and the droplet of the liquid may be smaller than a contact angle formed between the surface of the side wall 89 and the droplet of the liquid. When the wettability of the surface of the inclined side wall 87 is set higher than the wettability of the surface of the side wall 89, the liquid adhering to the inner bottom wall 88 is more likely to be attracted to the inclined side wall 87. When the wettability of the outer peripheral wall 86 is set higher than the wettability of the inclined side wall 87, the liquid adhering to the inclined side wall 87 is more likely to be attracted to the outer peripheral wall 86.

Operations of this embodiment will be described.

As shown in FIG. 4, when detaching the liquid supply coupling portion 50 in order to replace the liquid ejecting head 21, for example, the control portion 57 controls the wiping motor 68 and the carriage movement mechanism 49. The control portion 57 locates the case 66 at the downstream position by controlling the wiping motor 68. The control portion 57 moves the carriage 22 by controlling the carriage movement mechanism 49, thus moving the liquid ejecting head 21 to the detachment position DP. As a consequence, the liquid receiving portion 65A is opposed to the nozzle surface 45.

As shown in FIG. 9, when the maintenance cover 18 is located at the open position, the operator can access the carriage cover 55 from the opening 34*a*. When the carriage cover 55 is located at the open position, the operator can access the liquid supply coupling portion 50 and the fixation members 51 from the opening 34*a*.

The sensor 58 does not detect the carriage cover 55 when the carriage cover 55 is not located at the closed position. When detaching the liquid supply coupling portion 50, the control portion 57 may forbid the drive of the carriage movement mechanism 49 in a case in which the sensor 58 does not detect the carriage cover 55 located at the closed position after moving the liquid ejecting head 21 to the detachment position DP. When the sensor 58 does not detect the carriage cover 55 located at the closed position, the control portion 57 may forbid the supply of the liquids from the liquid supply sources 23 to the liquid ejecting head 21.

The carriage cover 55 is arranged such that at least part of the carriage cover 55 protrudes to the outside of the housing 34 from the opening 34*a* of the housing 34 when the carriage cover 55 is located at the open position that enables access to the liquid supply coupling portion 50. For this reason, even when the operator pushes and moves the carriage 22, the carriage cover 55 hits the rim of the opening 34*a*. Accordingly, the opening 34*a* functions as an example of a blocking portion provided to the housing 34, which comes into contact with the carriage cover 55 located at the open position, thus blocking the movement of the carriage 22 to stop the liquid ejecting head 21 from moving from the detachment position DP.

Figure 10:
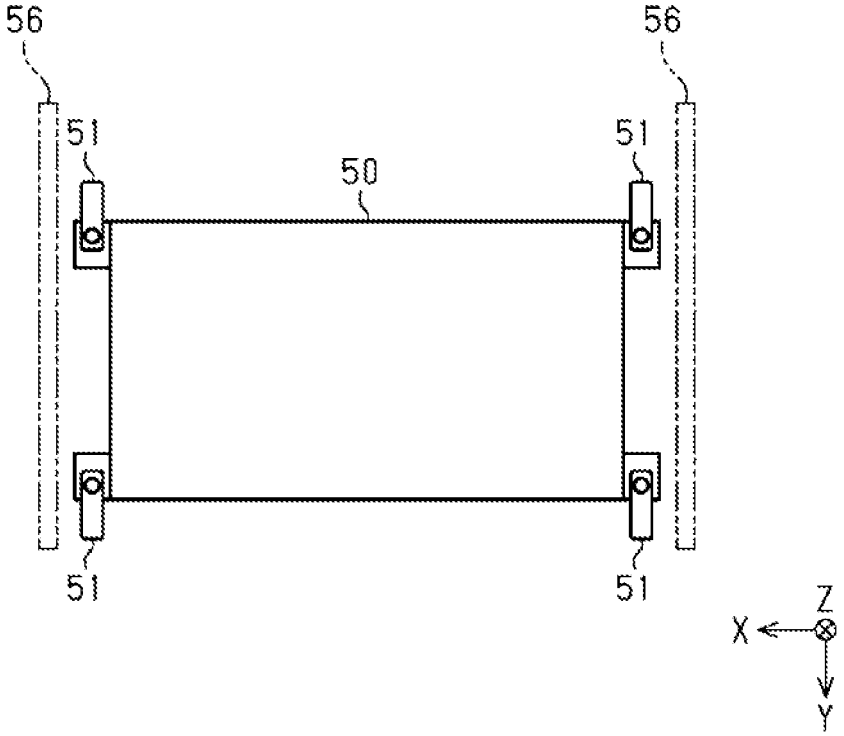
FIG. 10 is a schematic plan view of fixation members located at fixation positions.
Figure 11:
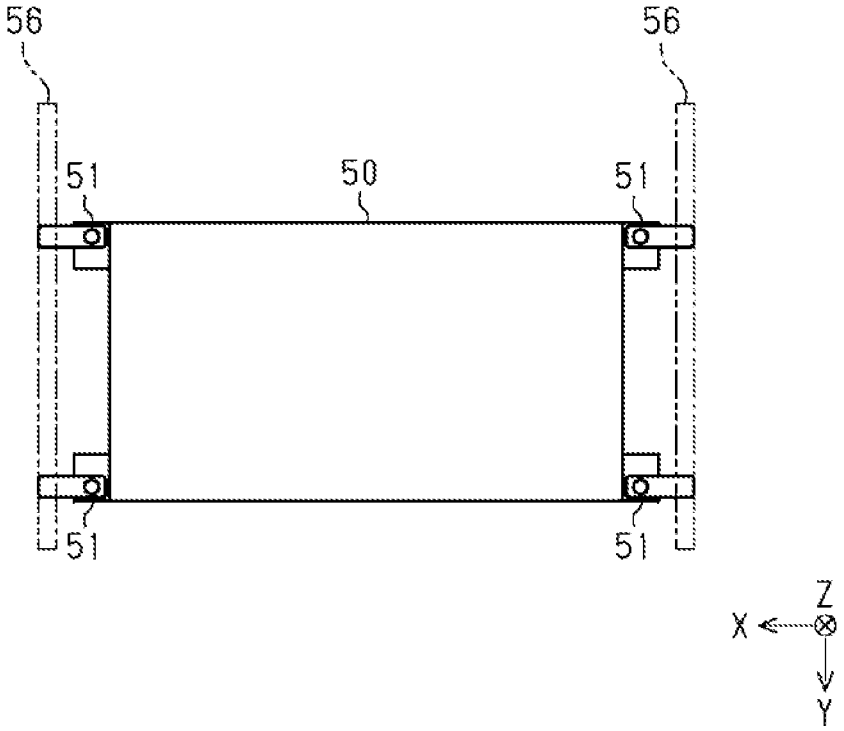
FIG. 11 is a schematic plan view of the fixation members located at release positions.

As shown in FIGS. 10 and 11, the four fixation members 51 are provided at four corners of the liquid supply coupling portion 50 in this embodiment. The fixation members 51 located at the fixation positions shown in FIG. 10 are turned in the state of being held by the liquid supply coupling portion 50 and are located at the release positions shown in FIG. 11. The release positions are the positions where the engagement of the fixation members 51 with the engagement portions 53 is released. The operator moves the fixation members 51 located at the fixation positions to the release positions, then detaches the liquid supply coupling portion 50, and replaces the liquid ejecting head 21.

As shown in FIG. 10, the carriage cover 55 may be provided with two contact portions 56. The two contact portions 56 are provided with an interval in the width direction X in-between. When the fixation members 51 are located at the fixation positions, the fixation members 51 are located between the two contact portions 56.

Figure 12:
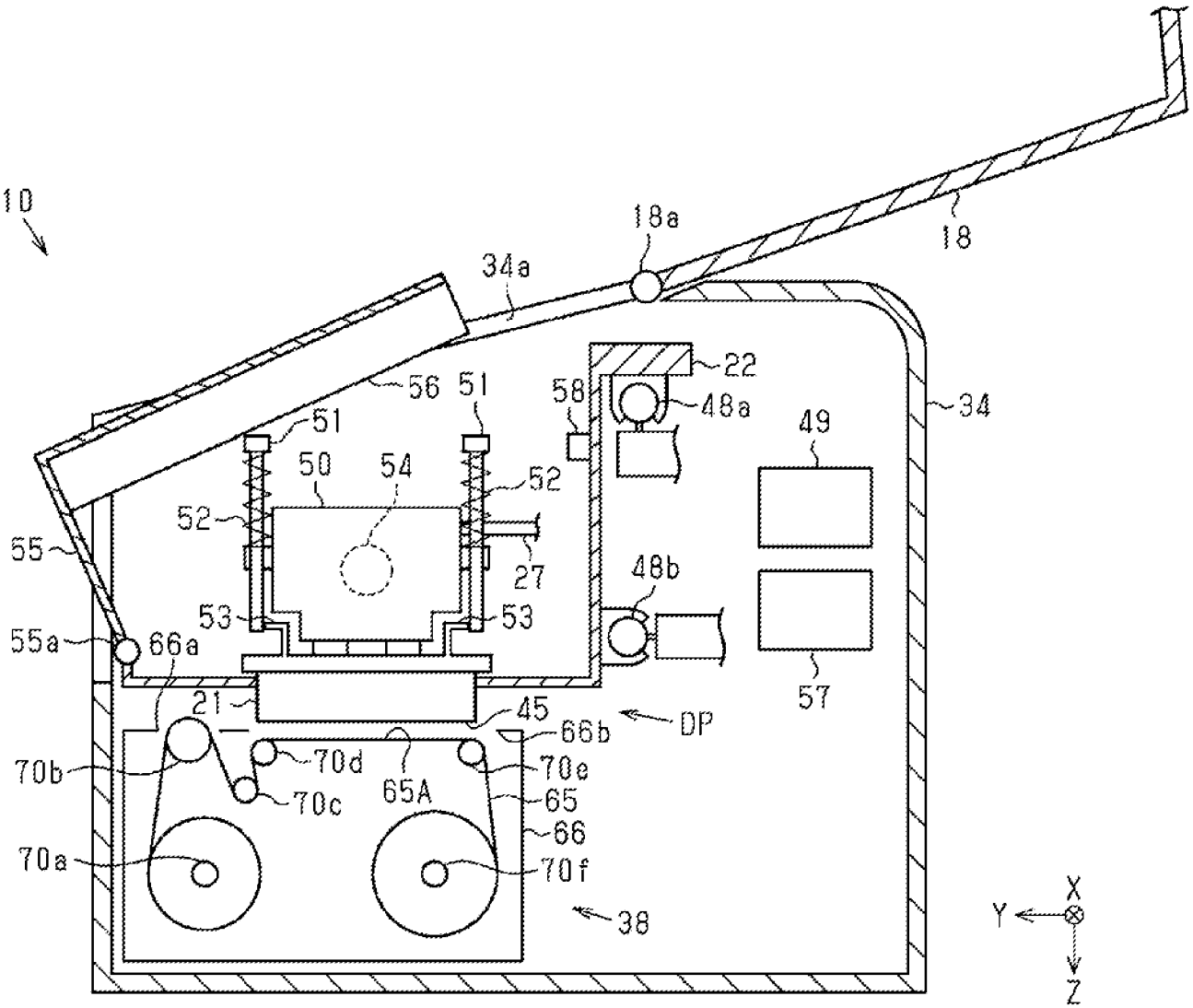
FIG. 12 is a schematic side view of the liquid ejecting apparatus in which the fixation members are located at the release positions.

As shown in FIGS. 11 and 12, the contact portions 56 come into contact with the fixation members 51 when an attempt is made to move the carriage cover 55 located at the open position to the closed position in the state where the fixation members 51 are located at the fixation positions. In other words, the contact portions 56 are in contact with the fixation members 51 when the carriage cover 55 is located at the position different from the closed position, and the carriage cover 55 does not move to the closed position as a consequence.

The carriage cover 55 is arranged such that at least part of the carriage cover 55 protrudes to the outside of the housing 34 from the opening 34*a* of the housing 34 when the contact portions 56 come into contact with the fixation members 51 located at the release positions. For this reason, even when the operator pushes and moves the carriage 22, the carriage cover 55 hits the rim of the opening 34*a*. Thus, the movement of the carriage 22 is blocked.

Effects of this embodiment will be described.

1. When detaching the liquid supply coupling portion 50, the carriage movement mechanism 49 moves the carriage 22 so as to locate the liquid ejecting head 21 at the detachment position DP. The liquid receiving portion 65A has the size equal to or larger than the nozzle surface 45 and is opposed to the nozzle surface 45. As a consequence, the liquid receiving portion 65A receives the leaking liquid even when the liquid leaks out of any of the nozzles 42 due to the detachment of the liquid supply coupling portion 50, thus reducing the risk of contamination of the liquid ejecting apparatus 10 with the liquid. Accordingly, it is possible to ensure quality after attachment and detachment of the liquid supply coupling portion 50 to and from the carriage 22 more easily.

2. The liquid receiving portion 65A is formed by drawing out the belt-like member 65, which is provided to the wiping device 38, such that the belt-like member 65 is opposed to the nozzle surface 45 located at the detachment position DP. As a consequence, the belt-like member 65 to be used for the wiping can also be used as the liquid receiving portion 65A.

3. The housing 34 includes the opening 34*a* which enables access to the carriage 22 located at the detachment position DP. As a consequence, the liquid supply coupling portion 50 mounted on the carriage 22 can be easily detached through the opening 34*a*.

4. When the carriage cover 55 is located at the open position, the blocking portion comes into contact with the carriage cover 55 and blocks the movement of the carriage 22. As a consequence, it is possible to retain the liquid ejecting head 21 at the detachment position DP in the state where the carriage cover 55 is located at the open position.

5. The opening 34*a* causes the liquid ejecting head 21 to be located at the detachment position DP by controlling the carriage movement mechanism 49. As a consequence, it is possible to perform detachment work on the liquid supply coupling portion 50 easily at the detachment position DP.

Second Embodiment

Next, a liquid ejecting apparatus according to a second embodiment will be described with reference to the drawings. Note that this second embodiment is different from the first embodiment in that the liquid ejecting apparatus includes at least two liquid ejecting heads and at least two liquid supply coupling portions. Meanwhile, the other features of the second embodiment are substantially the same as those of the first embodiment. Accordingly, the same constituents will be denoted by the same reference signs and overlapping explanations thereof will be omitted.

Figure 13:
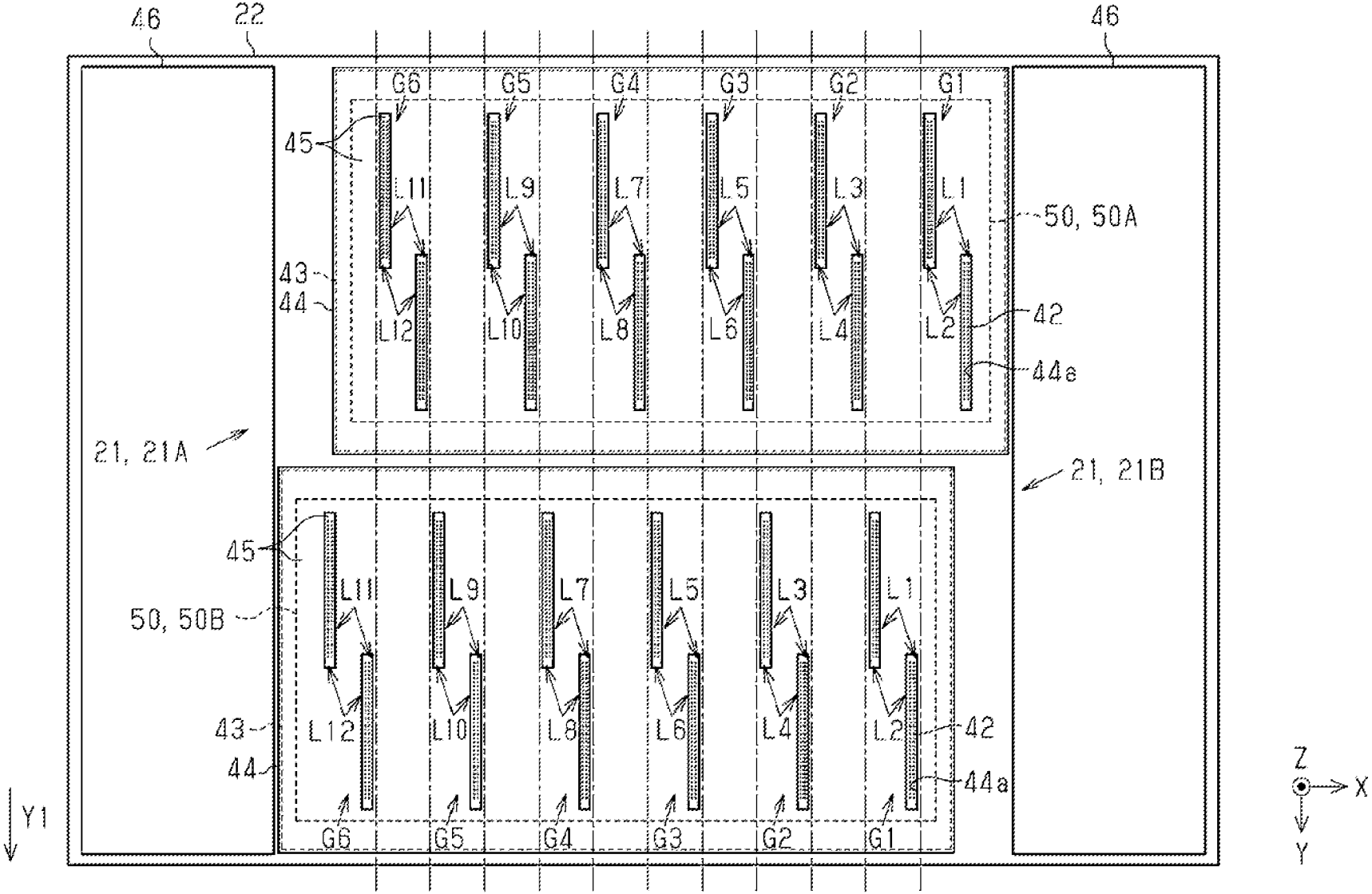
FIG. 13 is a schematic bottom view of a liquid ejecting head included in a liquid ejecting apparatus of a second embodiment.

As shown in FIG. 13, at least two liquid ejecting heads 21 and at least two liquid supply coupling portions 50 detachably coupled to the respective liquid ejecting heads 21 are mounted on the carriage 22. Specifically, the liquid ejecting apparatus 10 includes a first liquid ejecting head 21A and a second liquid ejecting head 21B arranged in the transport direction Y1, a first liquid supply coupling portion 50A coupled to the first liquid ejecting head 21A, and a second liquid supply coupling portion 50B coupled to the second liquid ejecting head 21B.

A configuration of each of the first liquid ejecting head 21A located upstream in the transport direction Y1 and the second liquid ejecting head 21B located downstream in the transport direction Y1 is the same as that of the liquid ejecting head 21 of the first embodiment. In this embodiment, the first liquid ejecting head 21A ejects the white ink from all of the nozzles 42 while the second liquid ejecting head 21B ejects the inks and the process liquids which are the same as those in the first embodiment.

The first liquid ejecting head 21A and the second liquid ejecting head 21B may be provided to the carriage 22 while displacing the locations from each other in the width direction X. In this embodiment, the first liquid ejecting head 21A is provided closer to the ejection area JA than the second liquid ejecting head 21B is when the carriage 22 is located in the maintenance area MA. The locations of the first to sixth nozzle groups G1 to G6 of the first liquid ejecting head 21A and those of the second liquid ejecting head 21B in the width direction X may be displaced from one another. As a consequence of this arrangement, when the wiping device 38 wipes the nozzle surface 45, it is possible to use different portions of the belt-like member 65 for wiping the neighborhood of the first to sixth nozzle groups G1 to G6 of the first liquid ejecting head 21A and for wiping the neighborhood of the first to sixth nozzle groups G1 to G6 of the second liquid ejecting head 21B.

To be more precise, the first nozzle group G1 of the second liquid ejecting head 21B is located between the first nozzle group G1 and the second nozzle group G2 of the first liquid ejecting head 21A in the width direction X. The second nozzle group G2 of the first liquid ejecting head 21A is located between the first nozzle group G1 and the second nozzle group G2 of the second liquid ejecting head 21B.

Figure 14:
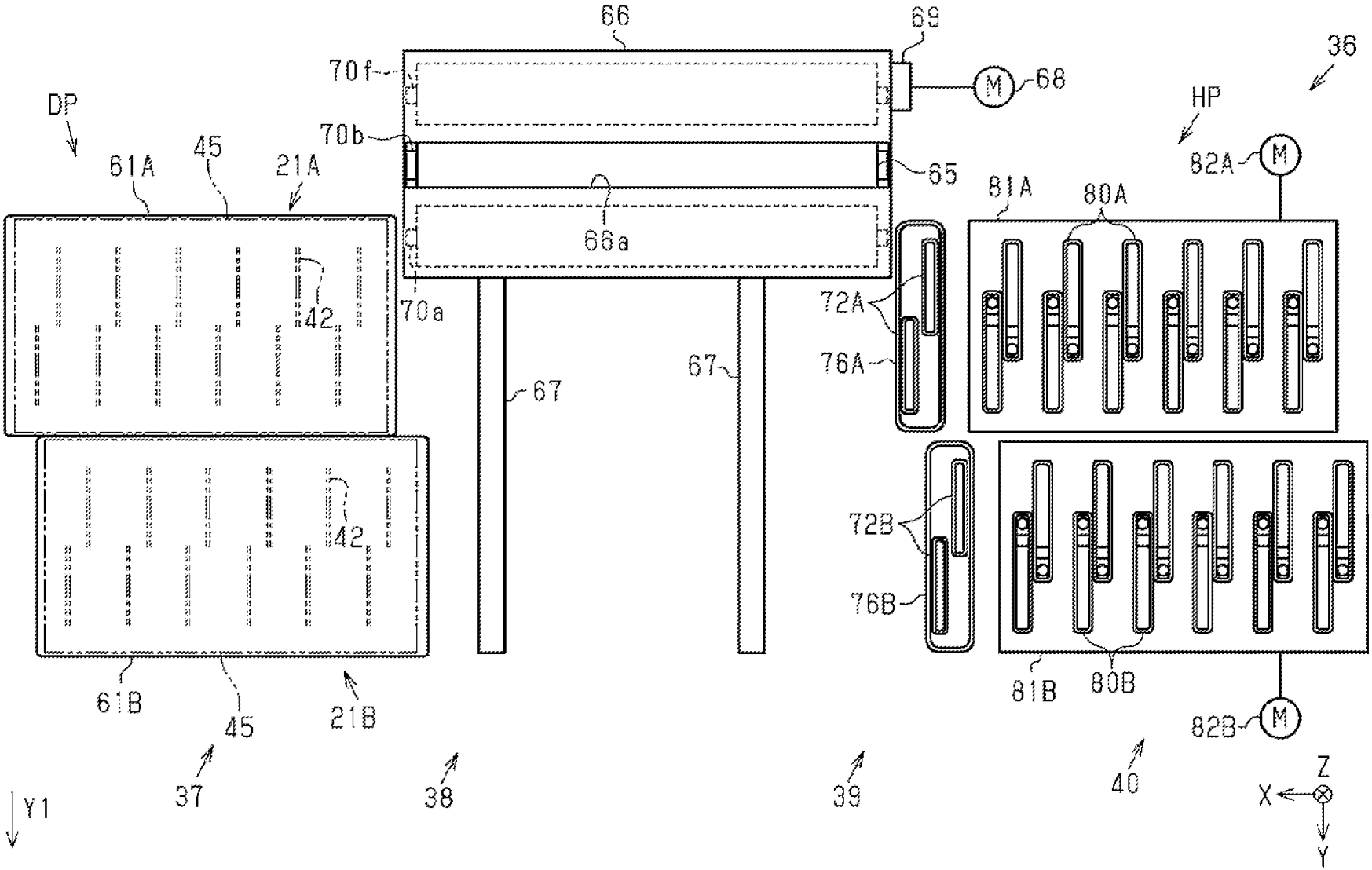
FIG. 14 is a schematic plan view of a maintenance unit.

As shown in FIG. 14, the liquid collection device 37 includes a first liquid receiving portion 61A and a second liquid receiving portion 61B arranged in the transport direction Y1. In this embodiment, the detachment positions DP for the first liquid ejecting head 21A and the second liquid ejecting head 21B are located above the liquid collection device 37. The first liquid receiving portion 61A is opposed to the nozzle surface 45 of the first liquid ejecting head 21A located at the detachment position DP. The first liquid receiving portion 61A is larger than the nozzle surface 45 in the width direction X and the depth direction Y. The second liquid receiving portion 61B is opposed to the nozzle surface 45 of the second liquid ejecting head 21B located at the detachment position DP. The second liquid receiving portion 61B is larger than the nozzle surface 45 in the width direction X and the depth direction Y. Accordingly, each of the first liquid receiving portion 61A and the second liquid receiving portion 61B functions as an example of the liquid receiving portion.

The wiping device 38 may include the reel-out shaft 70*a* that reels out the belt-like member 65, the pressure roller 70*b* that pushes up the belt-like member 65, and the roll-up shaft 70*f* that rolls up the used belt-like member 65.

The suctioning device 39 may include a first tub 76A and a second tub 76B arranged in the transport direction Y1, first suction caps 72A provided in the first tub 76A, and second suction caps 72B provided in the second tub 76B.

The capping device 40 may include a first stand-by holder 81A and a second stand-by holder 81B arranged in the transport direction Y1. The capping device 40 may include a first stand-by cap 80A held by the first stand-by holder 81A, and a first stand-by motor 82A that moves the first stand-by holder 81A. The capping device 40 may include a second stand-by cap 80B held by the second stand-by holder 81B, and a second stand-by motor 82B that moves the second stand-by holder 81B.

Operations of this embodiment will be described.

As shown in FIG. 14, when detaching the liquid supply coupling portion 50, the control portion 57 moves the carriage 22 by controlling the carriage movement mechanism 49, thereby moving the liquid ejecting head 21 to the detachment position DP. Thus, the first liquid receiving portion 61A is opposed to the nozzle surface 45 of the first liquid ejecting head 21A while the second liquid receiving portion 61B is opposed to the nozzle surface 45 of the second liquid ejecting head 21B.

When detaching one of the liquid supply coupling portions 50, the control portion 57 keeps the liquid ejecting head 21, which is coupled to the undetached liquid supply coupling portion 50, in a state where the liquid ejecting head 21 can eject the liquid. Specifically, when detaching the first liquid supply coupling portion 50A, the control portion 57 keeps the second liquid ejecting head 21B coupled to the undetached second liquid supply coupling portion 50B in the state where the second liquid ejecting head 21B can eject the liquid. The control portion 57 may perform the flushing by regularly ejecting the liquid from the second liquid ejecting head 21B during a period when the second liquid ejecting head 21B is located at the detachment position DP.

An effect of this embodiment will be described.

6. At least two liquid ejecting heads 21 and at least two liquid supply coupling portions 50 are mounted on the carriage 22. When detaching one of the liquid supply coupling portions 50, the liquid ejecting head 21 coupled to the other liquid supply coupling portion 50 is kept in the state where the liquid ejecting head 21 can eject the liquid. Thus, it is possible to reduce the risk of clogging of the nozzles 42 by ejecting the liquid from the liquid ejecting head 21 coupled to the undetached liquid supply coupling portion 50.

This embodiment can also be carried out in modified manners as described below. This embodiment and the following modified examples may be carried out in combination within the scope that is technically consistent.

Figure 15:
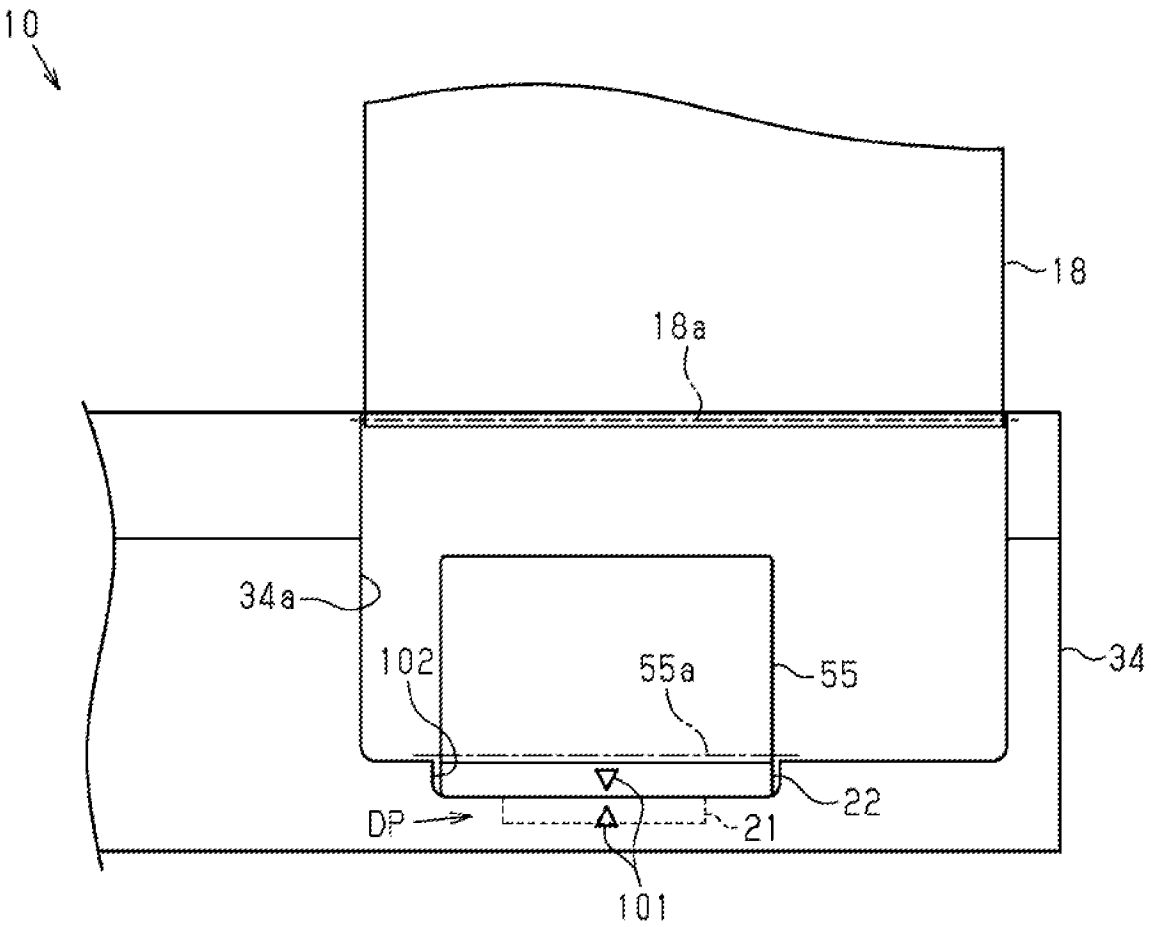
FIG. 15 is a schematic front view of a liquid ejecting apparatus of a modified example.

As shown in FIG. 15, the housing 34 and the carriage cover 55 may be provided with marks 101 indicating that the liquid ejecting head 21 is located at the detachment position DP. The operator may directly move the carriage 22 so as to locate the liquid ejecting head 21 at the detachment position DP. Specifically, when replacing the liquid ejecting head 21 that requires detachment of the liquid supply coupling portion 50, for example, the control portion 57 may turn off the electrical coupling to the liquid ejecting head 21 and the power supply to the carriage movement mechanism 49. In this case, the control portion 57 may also turn off the power supply to the sensor 58. When information indicating completion of attachment of the liquid ejecting head 21 and the liquid supply coupling portion 50 is inputted from the operation panel 17, the control portion 57 may turn on the electrical coupling to the liquid ejecting head 21, the power supply to the carriage movement mechanism 49, and the power supply to the sensor 58. The detachment of the liquid supply coupling portion 50 may be carried out in the state where the power supply to the liquid ejecting apparatus 10 is turned off. When the attachment of the liquid supply coupling portion 50 is completed, the operator may turn on the power supply to the liquid ejecting apparatus 10 so as to supply the power to the carriage movement mechanism 49 and the sensor 58. When the sensor 58 to which the power supply is resumed does not detect the carriage cover 55 located at the closed position, the control portion 57 may forbid the driving of the carriage movement mechanism 49.

As shown in FIG. 15, the housing 34 may include a blocking portion 102 that blocks the movement of the carriage 22 when the liquid ejecting head 21 is located at the detachment position DP and the carriage cover 55 is located at the open position. The blocking portion 102 may come into contact with the carriage cover 55 located at the open position in the state where liquid ejecting head 21 is located at the detachment position DP, or may be located while providing a gap between the blocking portion 102 and the carriage cover 55. The blocking portion 102 may be formed from a recess of part of the opening 34*a* recessed in accordance with the width of the carriage cover 55, for instance. This makes it possible to inhibit the carriage 22 from moving while keeping the carriage cover 55 located at the open position, and thus to inhibit the liquid ejecting head 21 from moving from the detachment position DP.

The liquid ejecting apparatus 10 may be provided with a blocking portion in such a way as to protrude from the opening 34*a* in accordance with the width of the carriage cover 55, and may block the movement of the carriage 22 by using the blocking portion. The blocking portion may be provided separately from the housing 34. Such blocking portions may be provided on two sides of the carriage cover 55 located at the open position, or one blocking portion may be provided on one side thereof. When the blocking portion is provided between the ejection area JA and the detachment position DP, it is possible to restrict the movement of the carriage 22 from the detachment position DP to the ejection area JA while keeping the carriage cover 55 located at the open position.

The carriage cover 55 in contact with the fixation members 51 located at the release positions may be located at such a position that does not cause interference with the housing 34. When the sensor 58 does not detect the carriage cover 55 located at the closed position and the carriage 22 is movable, the control portion 57 may determine that the fixation members 51 are located at the release positions. When the sensor 58 does not detect the carriage cover 55 located at the closed position and the carriage 22 is not movable, the control portion 57 may determine that the carriage cover 55 is located at the open position. For example, the control portion 57 may determine that the carriage 22 is movable when a load of the motor to move the carriage 22 is small, and may determine that the carriage 22 is not movable when the load is large.

The carriage cover 55 may be provided slidably between the open position and the closed position. The carriage cover 55 may be detachably fixed by using screws or fixtures. Such a fixture may be turnably provided at one of the carriage cover 55 and the carriage 22, for instance, and may be engaged with the other so as to fix the carriage 22 to the carriage cover 55.

The fixation members 51 may be provided separately from the liquid supply coupling portion 50. The fixation members 51 may be held by the carriage 22. The fixation members 51 may be held by the liquid ejecting head 21.

The first liquid ejecting head 21A and the second liquid ejecting head 21B may be provided to the carriage 22 in such a way as to be movable in the vertical direction Z. For example, when wiping the first liquid ejecting head 21A, the second liquid ejecting head 21B may be moved upward so as to wipe the first liquid ejecting head 21A only.

The suction cap 72 may be configured to cover all the nozzles 42 formed in the liquid ejecting head 21. The suction cap 72 may be formed larger than the nozzle surface 45. The suction cap 72 may cover the nozzle surface 45 while being in contact with a side surface of the liquid ejecting head 21. The detachment position DP may be defined at a position where the liquid ejecting head 21 is opposed to the suction cap 72, and the suction cap 72 may function as an example of the liquid receiving portion.

Three or more liquid ejecting heads 21 and three or more liquid supply coupling portions 50 detachably coupled to the respective liquid ejecting heads 21 may be mounted on the carriage 22.

The liquid collection device 37 may be opposed to the nozzle surfaces 45 provided to the respective liquid ejecting heads 21, and may include a single liquid receiving portion 61 that is larger than the nozzle surfaces 45 provided to the liquid ejecting heads 21.

The liquid does not necessarily have to be ejected from the second liquid ejecting head 21B during the detachment of the first liquid supply coupling portion 50A.

The liquid ejecting apparatus 10 may include discharge channels that enable discharge of the liquids having been supplied to the liquid ejecting head 21 out of the liquid ejecting head 21 in the state where the liquid ejecting head 21 is coupled to the liquid supply coupling portion 50, and the liquids may be put into circulation within the liquid ejecting head 21, the supply flow channels 27, and the discharge channels. Moreover, when detaching the first liquid supply coupling portion 50A, for example, the control portion 57 may circulate the liquid in the second liquid ejecting head 21B coupled to the undetached second liquid supply coupling portion 50B.

The first liquid ejecting head 21A located upstream in the transport direction Y1 may be configured to eject the white ink or the process liquids from all of the nozzles 42 while the second liquid ejecting head 21B located downstream in the transport direction Y1 may be configured to eject the color inks. In this case, the first liquid ejecting head 21A and the second liquid ejecting head 21B may be arranged such that a distance in the transport direction Y1 from the nozzle located at a downstream end in the transport direction Y1 of the first liquid ejecting head 21A and the nozzle located at an upstream end in the transport direction Y1 of the second liquid ejecting head 21B becomes larger than a length in the transport direction Y1 of the nozzle group that ejects the same liquid in one of the liquid ejecting heads 21.

The liquid ejecting apparatus 10 may include at least two carriages 22. The liquid ejecting apparatus 10 may include a first carriage that mounts the first liquid ejecting head 21A and the first liquid supply coupling portion 50A, and a second carriage that mounts the second liquid ejecting head 21B and the second liquid supply coupling portion 50B.

The attachment and detachment of the liquid supply coupling portion 50 may be performed while detaching the housing 34.

The liquid ejecting apparatus 10 may be a liquid ejecting apparatus that ejects or discharges a liquid other than the inks. Conditions of such a liquid to be discharged from the liquid ejecting apparatus in the form of a small amount of a droplet are assumed to include a granular shape, a teardrop shape, and a shape with a string-like long trail. The liquid discussed herein only needs to be a material that can be ejected from the liquid ejecting apparatus. The liquid only needs to be a substance being in the state of a liquid phase and examples thereof include a liquid body having high or low viscosity, sol, gel water, and other fluid bodies such as an inorganic solvent, an organic solvent, a solution, a liquid resin, a liquid metal, and a metallic melt. The liquid includes not only the liquid as a state of matter but also a substance obtained by dissolving, dispersing, or mixing particles of a functional material formed of solids such as pigments or metal particles into a solvent. Representative examples of the liquid include the inks as described above in the embodiment, liquid crystals, and so forth. Here, the inks encompass various liquid compositions including general water-based inks and oil-based inks, gel inks, hot-melt inks, and the like. Specific examples of the liquid ejecting apparatus include apparatuses that eject materials in a dispersed state or a dissolved state, the materials being any of electrode materials, coloring materials, and the like which are used for manufacturing liquid crystal display units, electroluminescence display units, surface-emitting display units, color filters, and so forth. The liquid ejecting apparatus may be any of an apparatus that ejects a bioorganic substance used for manufacturing a biochip, an apparatus used as a precision pipette for ejecting a liquid as a sample, a textile printing machine, a microdispenser, and the like. The liquid ejecting apparatus may be any of an apparatus that ejects a lubricant oil with pinpoint accuracy onto a precision instrument such as a watch and a camera, and an apparatus that ejects a transparent resin liquid such as an ultraviolet curable resin onto a substrate in order to form a micro semi-spherical lens, an optical lens, or the like used in a device such as an optical communication element. The liquid ejecting apparatus may be an apparatus that ejects an etchant of an acid, an alkali, and the like for etching a substrate and so forth.

Technical thought perceived by the embodiment and the modified examples mentioned above and the operation and effects thereof will be described below.

A liquid ejecting apparatus includes: a carriage that mounts a liquid ejecting head provided with a nozzle surface in which nozzles to eject a liquid are formed, the carriage being configured to move the liquid ejecting head between an ejection area used to cause the liquid ejecting head to eject the liquid onto a medium and a maintenance area used to perform maintenance of the liquid ejecting head; a liquid supply coupling portion that is mounted on the carriage and is detachably coupled to the liquid ejecting head so as to supply the liquid to the liquid ejecting head; a carriage movement mechanism that moves the carriage, when detaching the liquid supply coupling portion, to a detachment position provide in the maintenance area; and a liquid receiving portion that has a size equal to or larger than the nozzle surface, is opposed to the nozzle surface located at the detachment position, and receives the liquid discharged from the nozzles.

According to this configuration, when detaching the liquid supply coupling portion, the carriage movement mechanism moves the carriage to the detachment position. The liquid receiving portion has the size equal to or larger than the nozzle surface and is opposed to the nozzle surface. As a consequence, the liquid receiving portion receives the leaking liquid even when the liquid leaks out of any of the nozzles due to the detachment of the liquid supply coupling portion, thus reducing the risk of contamination of the liquid ejecting apparatus with the liquid. Accordingly, it is possible to ensure quality after attachment and detachment of the liquid supply coupling portion to and from the carriage more easily.

In the liquid ejecting apparatus, a wiping device may be provided in the maintenance area, the wiping device including a belt-like member having a width equal to or larger than the nozzle surface, and being configured to wipe the nozzle surface by bringing the belt-like member into contact with the nozzle surface. Moreover, the liquid receiving portion may be formed by drawing out the belt-like member such that the belt-like member is opposed to the nozzle surface located at the detachment position.

According to this configuration, the liquid receiving portion is formed by drawing out the belt-like member provided to the wiping device such that the belt-like member is opposed to the nozzle surface located at the detachment position. As a consequence, the belt-like member to be used for the wiping can also be used as the liquid receiving portion.

The liquid ejecting apparatus may further include: a housing that surrounds the ejection area and the maintenance area. Here, the housing may include an opening that enables access to the carriage located at the detachment position.

The housing includes the opening which enables access to the carriage located at the detachment position. As a consequence, the liquid supply coupling portion mounted on the carriage can be easily detached through the opening.

The liquid ejecting apparatus may further include a carriage cover openably and closably provided to the carriage; and a blocking portion that is provided to the housing and comes into contact with the carriage cover located at an open position, and blocks movement of the carriage from the detachment position.

According to this configuration, when the carriage cover is located at the open position, the blocking portion comes into contact with the carriage cover and blocks the movement of the carriage. As a consequence, it is possible to retain the liquid ejecting head at the detachment position in the state where the carriage cover is located at the open position.

The liquid ejecting apparatus may further include a control portion that causes the carriage to move and locate the liquid ejecting head at the detachment position by controlling the carriage movement mechanism when detaching the liquid supply coupling portion.

According to this configuration, the control portion causes the liquid ejecting head to be located at the detachment position by controlling the carriage movement mechanism. As a consequence, it is possible to perform the detachment work on the liquid supply coupling portion easily at the detachment position.

In the liquid ejecting apparatus, the carriage may mount at least the two liquid ejecting heads and at least the two liquid supply coupling portions to be detachably coupled to the liquid ejecting heads, respectively. Moreover, when detaching one of the liquid supply coupling portions, the control portion may keep the liquid ejecting head that is coupled to the undetached liquid supply coupling portion in a state enabled to eject the liquid.

According to this configuration, at least two liquid ejecting heads and at least two liquid supply coupling portions are mounted on the carriage. When detaching one of the liquid supply coupling portions, the liquid ejecting head coupled to the other liquid supply coupling portion is kept in the state where enabled to eject the liquid. Thus, it is possible to reduce the risk of clogging of the nozzles by ejecting the liquid from the liquid ejecting head coupled to the undetached liquid supply coupling portion.

A method of controlling a liquid ejecting may be a method of controlling a liquid ejecting apparatus provided with: a carriage that mounts a liquid ejecting head provided with a nozzle surface in which nozzles to eject a liquid are formed, the carriage being configured to move the liquid ejecting head between an ejection area used to cause the liquid ejecting head to eject the liquid onto a medium and a maintenance area used to perform maintenance of the liquid ejecting head, a liquid supply coupling portion that is mounted on the carriage and is detachably coupled to the liquid ejecting head so as to supply the liquid to the liquid ejecting head, a carriage movement mechanism that moves the carriage, and a liquid receiving portion that has a size equal to or larger than the nozzle surface, is opposed to the nozzle surface located at a detachment position provided in the maintenance area, and receives the liquid discharged from the nozzles. Here, the method may include: moving the carriage so as to locate the liquid ejecting head at the detachment position when detaching the liquid supply coupling portion.

According to this method, when detaching the liquid supply coupling portion, the carriage is moved so as to locate the liquid ejecting head at the detachment position. The liquid receiving portion has the size equal to or larger than the nozzle surface and is opposed to the nozzle surface. As a consequence, the liquid receiving portion receives the leaking liquid even when the liquid leaks out of any of the nozzles due to the detachment of the liquid supply coupling portion, thus reducing the risk of contamination of the liquid ejecting apparatus with the liquid. Accordingly, it is possible to ensure quality after attachment and detachment of the liquid supply coupling portion to and from the carriage more easily.

In the method of controlling a liquid ejecting apparatus, the carriage may mount at least the two liquid ejecting heads and at least the two liquid supply coupling portions to be detachably coupled to the liquid ejecting heads, respectively. Moreover, when detaching one of the liquid supply coupling portions, the method may include keeping the liquid ejecting head that is coupled to the undetached liquid supply coupling portion in a state where enabled to eject the liquid.

According to this method, at least two liquid ejecting heads and at least two liquid supply coupling portions are mounted on the carriage. When detaching one of the liquid supply coupling portions, the liquid ejecting head coupled to the other liquid supply coupling portion is kept in the state where enabled to eject the liquid. Thus, it is possible to reduce the risk of clogging of the nozzles by ejecting the liquid from the liquid ejecting head coupled to the undetached liquid supply coupling portion.

What is claimed is:

1. A liquid ejecting apparatus comprising:

a carriage that mounts a liquid ejecting head provided with a nozzle surface in which nozzles to eject a liquid are formed, the carriage being configured to move the liquid ejecting head between an ejection area used to cause the liquid ejecting head to eject the liquid onto a medium and a maintenance area used to perform maintenance of the liquid ejecting head;

a liquid supply coupling portion that is mounted directly on the carriage and is detachably coupled to the liquid ejecting head so as to supply the liquid to the liquid ejecting head;

a carriage movement mechanism that moves the carriage when detaching the liquid supply coupling portion, to a detachment position provided in the maintenance area;

a liquid receiving portion that has a size equal to or larger than the nozzle surface, is opposed to the nozzle surface located at the detachment position, and receives the liquid discharged from the nozzles;

a carriage cover openably and closably provided to the carriage;

a blocking portion that comes into contact with the carriage cover located at an open position, and blocks movement of the carriage to stop the liquid ejecting head from moving from the detachment position; and a fixation member configured to move between a fixation position for fixing the liquid supply coupling portion to the carriage and a release position for releasing a fixing of the liquid supply coupling portion to the carriage, wherein the fixation member in the release position prevents the carriage cover from moving from the open position to a closed position.

2. The liquid ejecting apparatus according to claim 1, wherein a wiping device is provided in the maintenance area, the wiping device including a belt-like member having a width equal to or larger than the nozzle surface, and being configured to wipe the nozzle surface by bringing the belt-like member into contact with the nozzle surface, and the liquid receiving portion is formed by drawing out the belt-like member such that the belt-like member is opposed to the nozzle surface located at the detachment position.

3. The liquid ejecting apparatus according to claim 1, further comprising:

a housing that surrounds the ejection area and the maintenance area, wherein the housing includes an opening that enables access to the carriage located at the detachment position.

4. The liquid ejecting apparatus according to claim 3, wherein the blocking portion is provided to the housing.

5. The liquid ejecting apparatus according to claim 1, further comprising:

a control portion that causes the carriage to move and locate the liquid ejecting head at the detachment position by controlling the carriage movement mechanism when detaching the liquid supply coupling portion.

6. The liquid ejecting apparatus according to claim 5, wherein the carriage mounts at least two liquid ejecting heads and at least two liquid supply coupling portions to be detachably coupled to the liquid ejecting heads, respectively, and when detaching one of the liquid supply coupling portions, the control portion keeps the liquid ejecting head that is coupled to the undetached liquid supply coupling portion in a state enabled to eject the liquid.

7. The liquid ejecting apparatus according to claim 1, further comprising:

a housing that surrounds the ejection area and the maintenance area, wherein the blocking portion comprises an opening in the housing, the opening including a rim portion adjacent a shaft that causes the carriage cover to open and close, when the carriage cover locates at an open position, the carriage cover comes into contact with the rim portion to thereby blocks movement of the carriage.

8. A method of controlling a liquid ejecting apparatus including a carriage that mounts a liquid ejecting head provided with a nozzle surface in which nozzles to eject a liquid are formed, the carriage being configured to move the liquid ejecting head between an ejection area used to cause the liquid ejecting head to eject the liquid onto a medium and a maintenance area used to perform maintenance of the liquid ejecting head, a liquid supply coupling portion that is mounted directly on the carriage and is detachably coupled to the liquid ejecting head so as to supply the liquid to the liquid ejecting head, a carriage movement mechanism that moves the carriage, a liquid receiving portion that has a size equal to or larger than the nozzle surface, is opposed to the nozzle surface located at a detachment position provided in the maintenance area, and receives the liquid discharged from the nozzles, a carriage cover openably and closably provided to the carriage, a blocking portion that comes into contact with the carriage cover located at an open position, and blocks movement of the carriage to stop the liquid ejecting head from moving from the detachment position, and a fixation member configured to move between a fixation position for fixing the liquid supply coupling portion to the carriage and a release position for releasing a fixing of the liquid supply coupling portion to the carriage, the method comprising:

moving the carriage so as to locate the liquid ejecting head at the detachment position when detaching the liquid supply coupling portion.

9. The method of controlling a liquid ejecting apparatus according to claim 8, wherein the carriage mounts at least two liquid ejecting heads and at least two liquid supply coupling portions to be detachably coupled to the liquid ejecting heads, respectively, and when detaching one of the liquid supply coupling portions, the method includes keeping the liquid ejecting head that is coupled to the undetached liquid supply coupling portion in a state enabled to eject the liquid.

* * * * *